US011691863B2

(12) United States Patent
Theofilos

(10) Patent No.: US 11,691,863 B2
(45) Date of Patent: Jul. 4, 2023

(54) VENTED FUNNEL WITH FLUID FLOW STOPPER

(71) Applicant: SNJ Patents, LLC, Palm Beach Gardens, FL (US)

(72) Inventor: Charles Theofilos, Palm Beach Gardens, FL (US)

(73) Assignee: SNJ Patents, LLC, Palm Beach Gardens, FL (US)

( * ) Notice: Subject to any disclaimer, the term of this patent is extended or adjusted under 35 U.S.C. 154(b) by 0 days.

(21) Appl. No.: 17/649,686

(22) Filed: Feb. 2, 2022

(65) Prior Publication Data

US 2022/0250889 A1 Aug. 11, 2022

Related U.S. Application Data

(60) Provisional application No. 63/170,796, filed on Apr. 5, 2021, provisional application No. 63/144,605, filed on Feb. 2, 2021.

(51) Int. Cl.
*B67C 11/02* (2006.01)
*B67C 11/00* (2006.01)

(52) U.S. Cl.
CPC ..... *B67C 11/02* (2013.01); *B67C 2011/20* (2013.01); *B67C 2011/30* (2013.01); *B67C 2011/40* (2013.01)

(58) Field of Classification Search
CPC . B67C 11/02; B67C 2011/20; B67C 2011/30; B67C 2011/40
See application file for complete search history.

(56) References Cited

U.S. PATENT DOCUMENTS 5,511,595 A * 4/1996 Stidham ..... B67C 11/04 141/297
2019/0263649 A1* 8/2019 Buhler ..... B67C 11/066

* cited by examiner

*Primary Examiner* — Jason K Niesz
(74) *Attorney, Agent, or Firm* — McHale & Slavin, P.A.

(57) ABSTRACT

A vented funnel having a fluid flow stop configured to provide even fluid flow or to maximize fluid flow. The vented funnel with fluid flow stop may include an inner funnel member and an outer vented funnel member. The outer vented funnel member may have one or more venting portions or configurations configured to provide a mechanism for allowing trapped air within the vented funnel to be expelled.

20 Claims, 37 Drawing Sheets

VENTED FUNNEL WITH FLUID FLOW STOPPER

CROSS REFERENCE TO RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 63/144,605, entitled "VENTED FUNNEL", filed Feb. 2, 2021, and U.S. Provisional Patent Application No. 63/170,796, entitled "VENTED FUNNEL WITH FLUID FLOW STOPPER", filed Apr. 5, 2021. The contents of the above referenced applications are incorporated herein by reference in their entirety.

FIELD OF THE INVENTION

The present invention relates to fluid guiding devices; to a funnel configured to provide for more even fluid flow; and more particularly, to a vented funnel with a fluid flow prevention mechanism or a vented funnel without a fluid flow prevention mechanism.

BACKGROUND OF THE INVENTION

Devices, such as funnels, for use in transferring a fluid from a first transfer container to a second fluid receiving container are well known. The typical funnel uses a wide area or cup portion which is designed to receive a fluid, and a stem portion which is designed to rest or fit within the fluid receiving container. As a user pours a fluid out from the transfer container into the fluid cup portion, the fluid travels from the cup portion into the fluid receiving container through the stem portion. Fluid transfer through the funnel may be slowed as a result of trapped air within the funnel. Mechanisms for removing the trapped air may result in more even fluid flow, resulting in more efficient fluid transfer.

SUMMARY OF THE INVENTION

Embodiments of the invention include a vented funnel with fluid flow stop configured to provide for more even fluid flow or to maximize fluid flow and to provide a mechanism to prevent fluid flow when required. The vented funnel with fluid flow stop may include an inner fluid flow stopper funnel member and an outer vented funnel member. The outer vented funnel member may have one or more venting portions or configurations configured to provide a mechanism for allowing trapped air within the vented funnel to be expelled.

Embodiments of the invention may also include a vented funnel configured to provide for more even fluid flow or to maximize fluid flow. The vented funnel may include a top portion and a stem portion, with the top portion being larger than the stem portion. The vented funnel may have one or more venting tubes configured to provide a mechanism for allowing trapped air within the vented funnel to be expelled.

Accordingly, it is an objective of the invention to provide an improved funnel.

It is a further objective of the invention to provide a vented funnel.

It is yet another objective of the invention to provide a vented funnel configured to provide even fluid flow.

It is a still further objective of the invention to provide a vented funnel configured to provide maximized fluid flow.

It is a further objective of the invention to provide a vented funnel having an inner member configured for preventing fluid flow.

It is yet another objective of the invention to provide a vented funnel configured to provide even fluid flow having an inner member configured for preventing fluid flow.

It is a still further objective of the invention to provide a vented funnel configured to provide maximized fluid flow having an inner member configured for preventing fluid flow.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
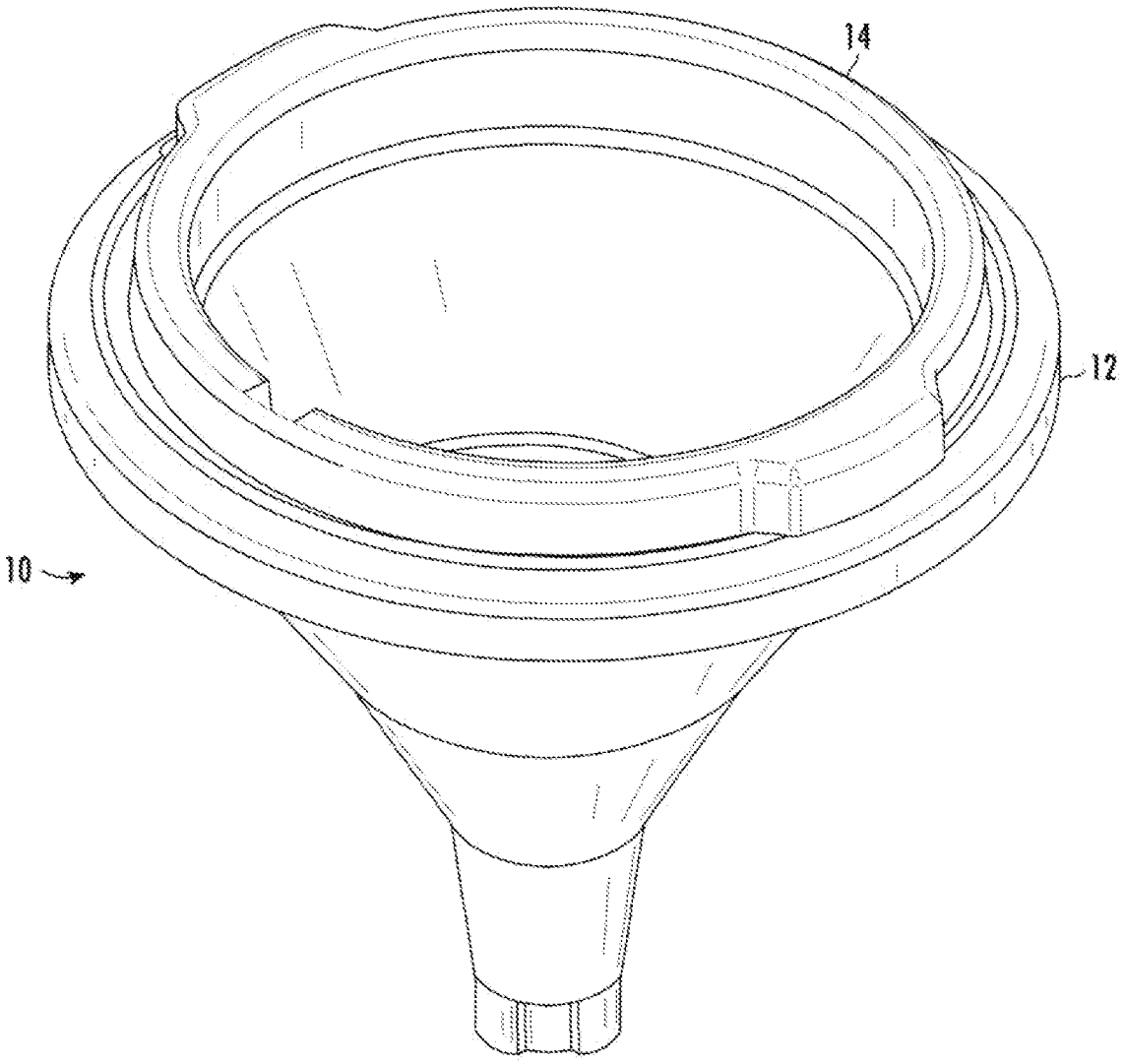
FIG. 1 is a top perspective view of an illustrative example of a vented funnel with fluid flow stop, shown in the fluid flow position.
Figure 2:
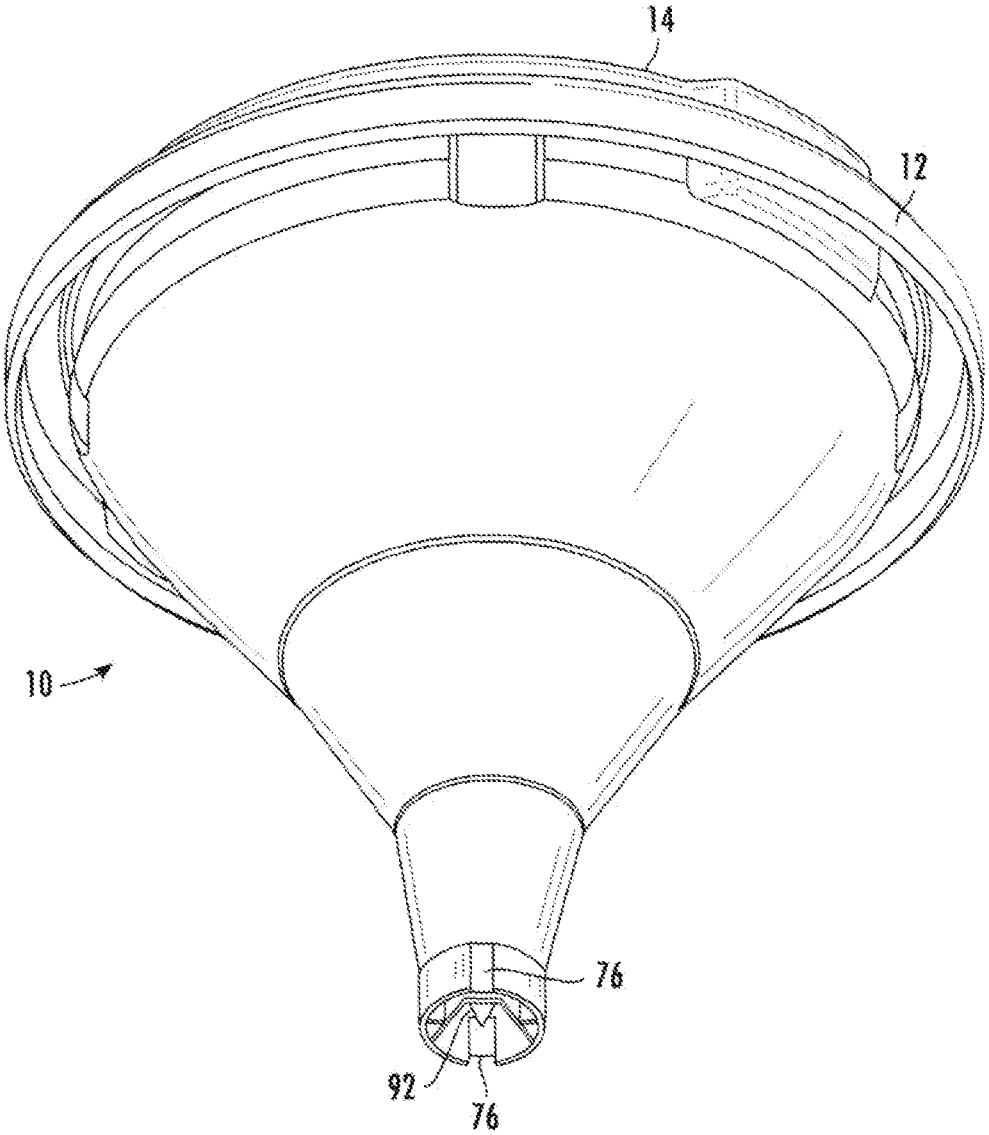
FIG. 2 is a bottom perspective view of the vented funnel with fluid flow stop.
Figure 3:
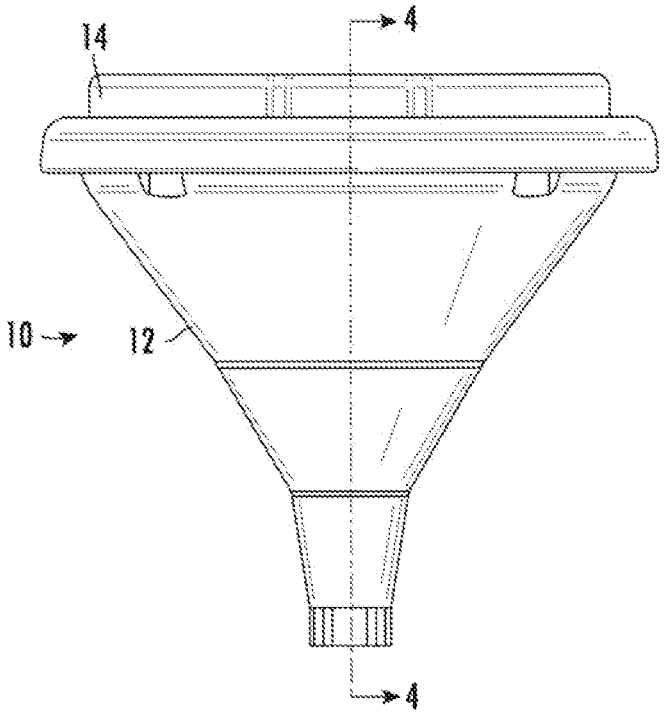
FIG. 3 is a side view of the vented funnel with fluid flow stop.
Figure 4:
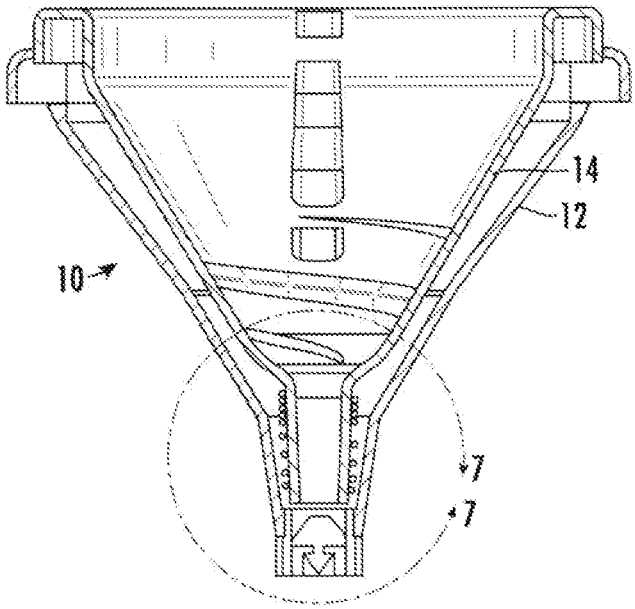
FIG. 4 is a cross-sectional view of the vented funnel with fluid flow stop, taken along long lines 3-3 in FIG. 3.
Figure 5:
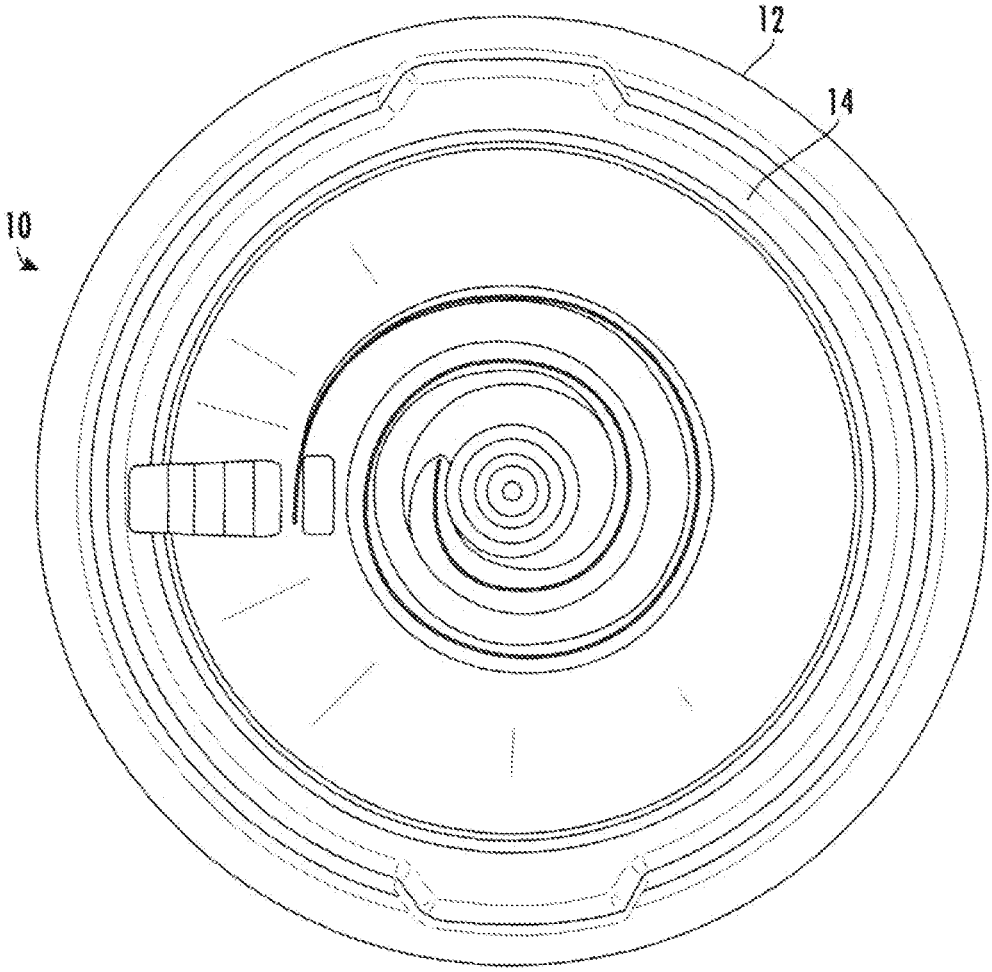
FIG. 5 is a top view of the vented funnel with fluid flow stop.
Figure 6:
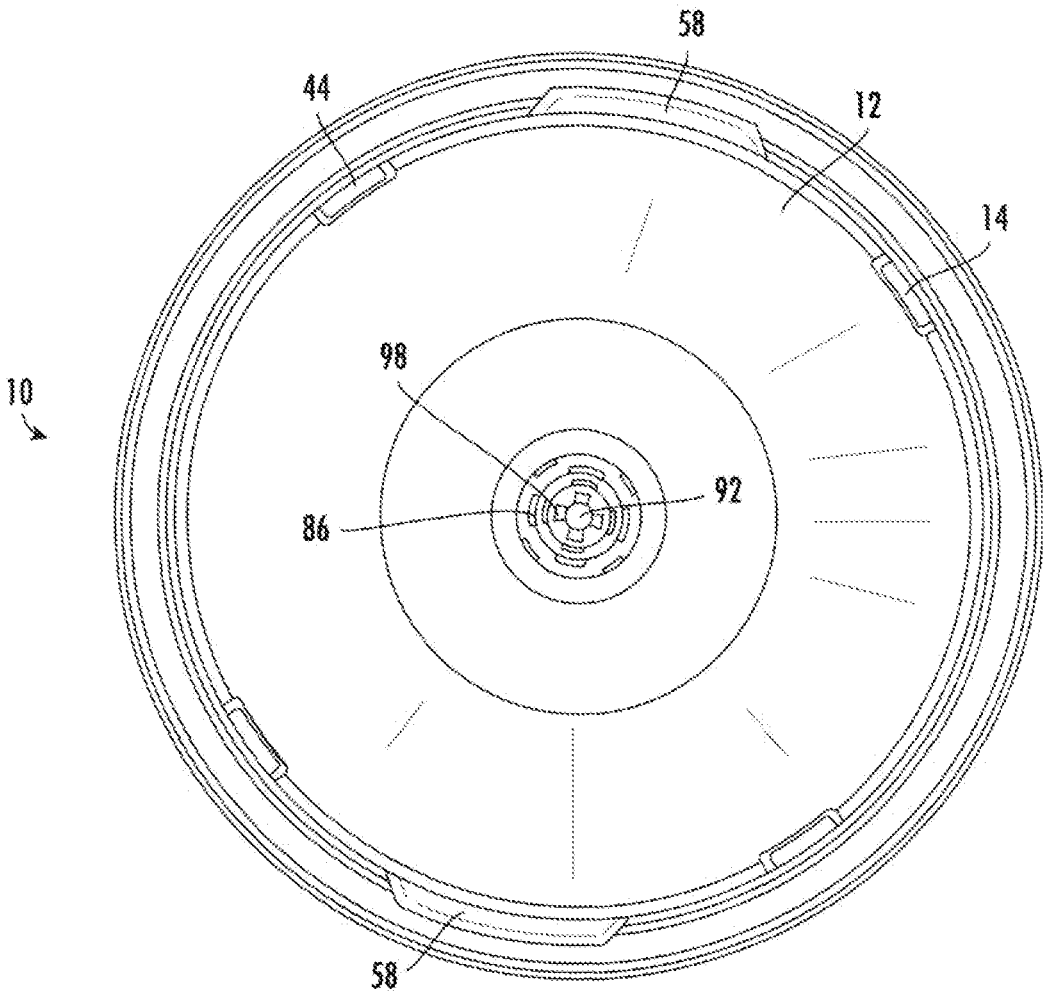
FIG. 6 is a bottom view of the vented funnel with fluid flow stop.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-9, an illustrative example of a funnel, referred to herein as a vented funnel with fluid flow stop 10, is shown. The vented funnel with fluid flow stop 10 is configured to 1) provide for more even fluid flow, 2) to maximize fluid flow, and 3) prevent fluid flow when needed. The vented funnel with fluid flow stop 10 comprises an outer funnel member 12 and an inner funnel member 14, the inner funnel member 14 configured to fit within the outer funnel member 12.

Referring to FIGS. 10-15, an embodiment of the outer funnel member 12 is shown. The outer funnel member 12 may include a top portion 16 and a stem portion 18. The top portion 16 includes a first end 20, a second opposing end 22, and a wall therebetween having an outer surface 26 and an interior 28 having an inner surface 30. The interior 28 is configured to receive and hold portions of the inner funnel member 14, receive a fluid, hold a fluid, or allow a fluid to pass. The wall 24, which forms the top portion 16, preferably has a tapering, from a larger section at the first end 20 to a smaller portion at the second, opposing end 22. Integrally formed or attached to the first end 20 is an edge or lip 32. The edge or lip 32 extends around the perimeter of the outer funnel member top portion 16. The top portion 16 is shown having a conical shape, being wider at the edge or lip 32 and narrower at or near the outer funnel member stem portion 18. The edge or lip 32 may be formed having a folded over wall 34, this forming a gap 36 between the wall 34 and the outer surface 26. The width Do, see FIG. 13, of the edge 32 may define an outer perimeter 38 and an inner perimeter 40. The outer funnel member top portion 16 is designed to be larger, i.e. have a larger diameter, than the outer funnel member stem portion 18.

The outer funnel member 12 and the inner funnel member 14 are arranged to allow the inner funnel member 14 to rest and move within the outer funnel member 12. Preferably positioned within the edge or lip 32, are one or more inner member engagement members 42, see for example, FIG. 10, 12, or 13. The inner member engagement members 42 are designed to engage with one or more outer member engagement members 44, see FIG. 6 (described in greater detail below), thus allowing the inner funnel member 14 to float and/or move within the outer funnel member 12, traversing or moving between a first position, fluid flow orientation, to a second position, non-fluid flow orientation, while maintaining its position within the outer funnel member 12. As illustrated, the one or more inner member engagement members 42 are shown as a cut out area 46 defined by two opposing side walls 48, 50, a top wall 52, and an opposing bottom wall 54. In the embodiment illustrated, there are four inner member engagement members 42 shown, each evenly spaced apart about the perimeter of the edge or lip 32. While shown with four inner member engagement members 42, embodiments of the invention may include more than four, or less than four. An angled or slanted surface 56 may extend from the bottom wall 54, into the outer funnel member top portion 16 may be an angled or slanted surface 56.

Figure 12:
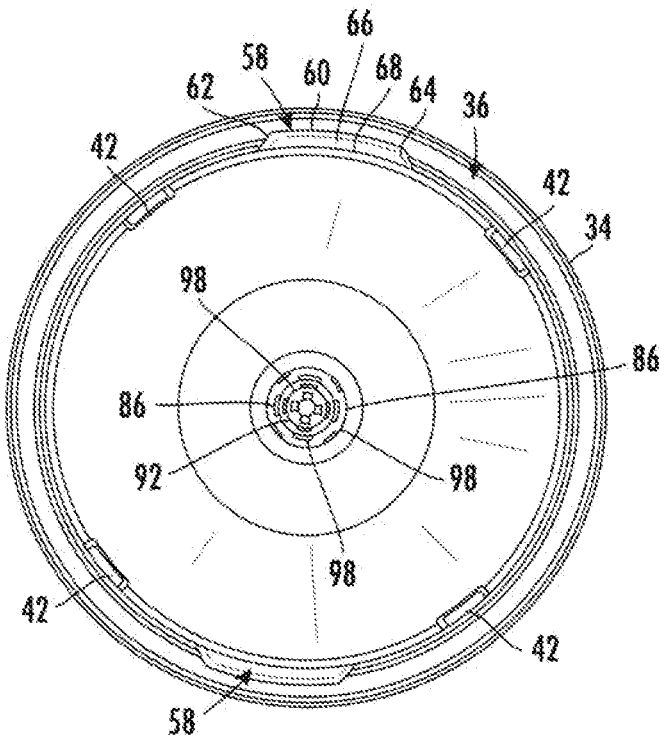
FIG. 12 is a top view of the outer funnel member.
Figure 13:
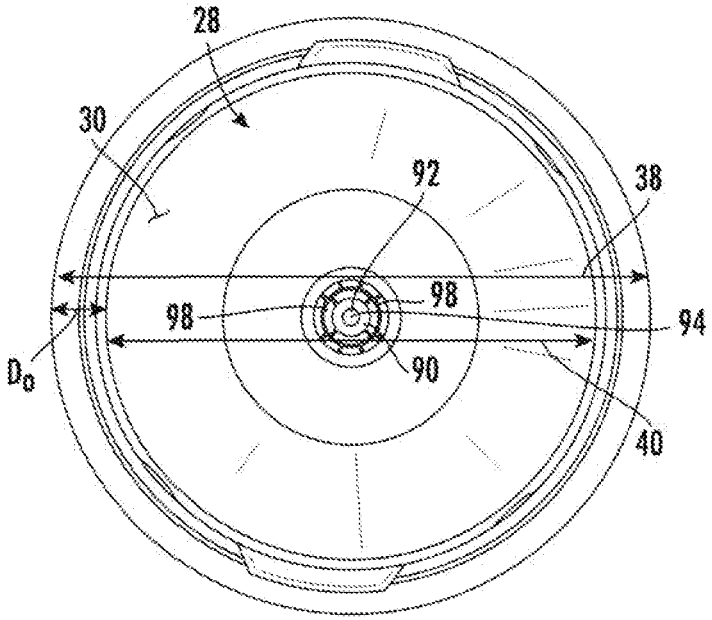
FIG. 13 is a bottom view of the outer funnel member.
Figure 14:
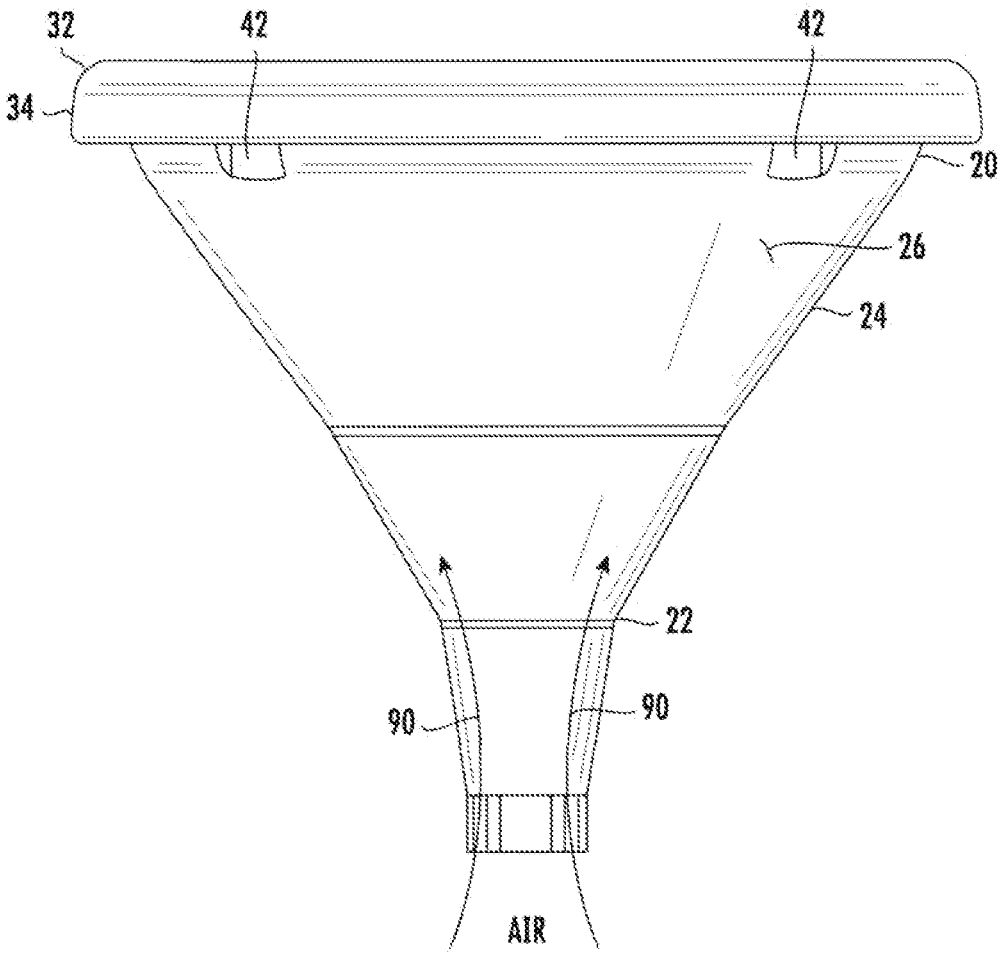
FIG. 14 is a side view of the outer funnel member.
Figure 15:
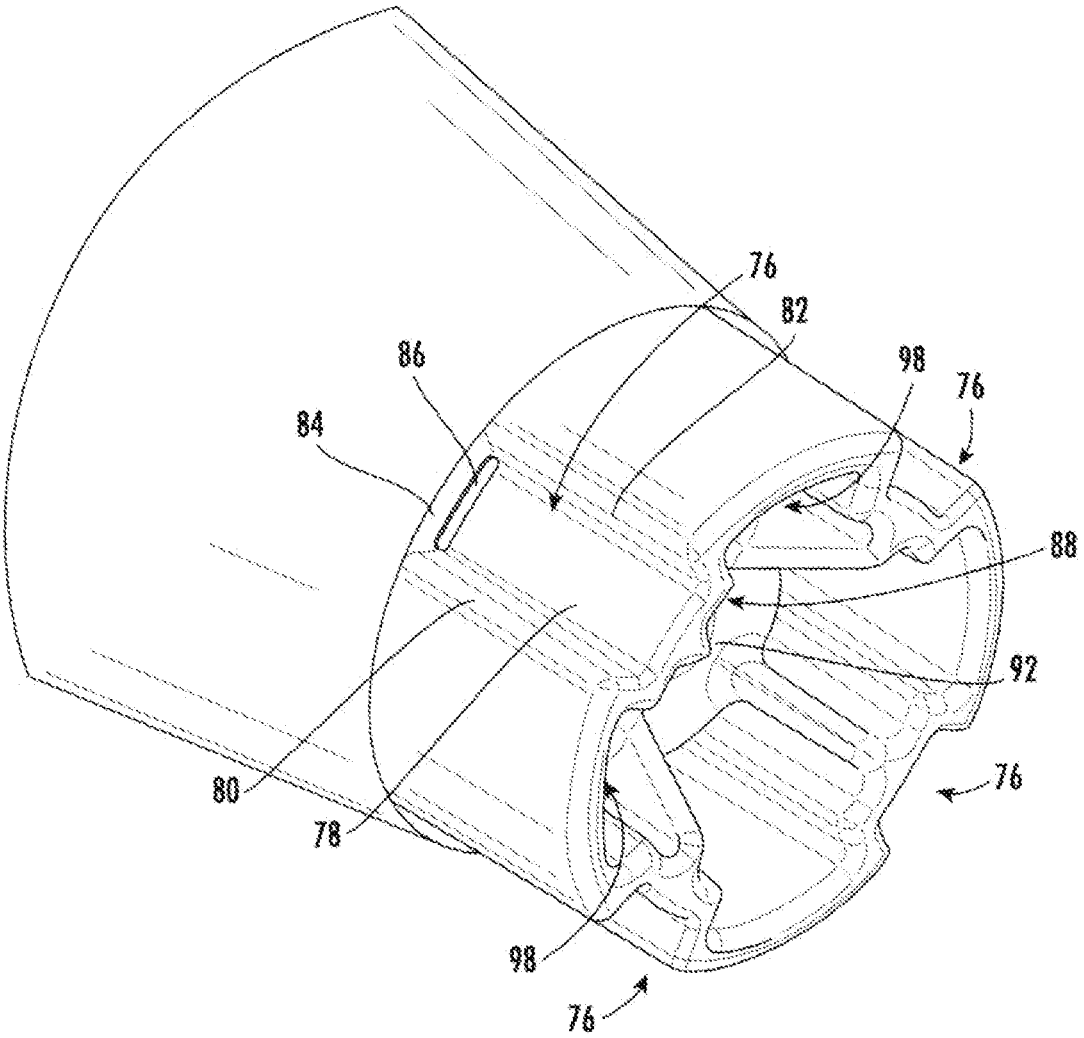
FIG. 15 is a close-up view of the bottom end of the outer funnel member.

The outer funnel member 12 may also include one or more secondary inner member engagement members 58, see FIG. 12. The secondary inner member engagement members 58 are designed to receive one or more portions of the inner funnel member 14. The secondary inner member engagement members 58 are shown having a cut-out section 60 within a portion of the edge or lip 32, defined by two opposing sides walls 62, 64, a back wall 66, and a seat or landing wall 68. Both the cut-out section 60 and the seat or landing wall 68 are sized and shaped to receive and or engage with the one or more portions of the inner funnel member 14.

Figure 11A:
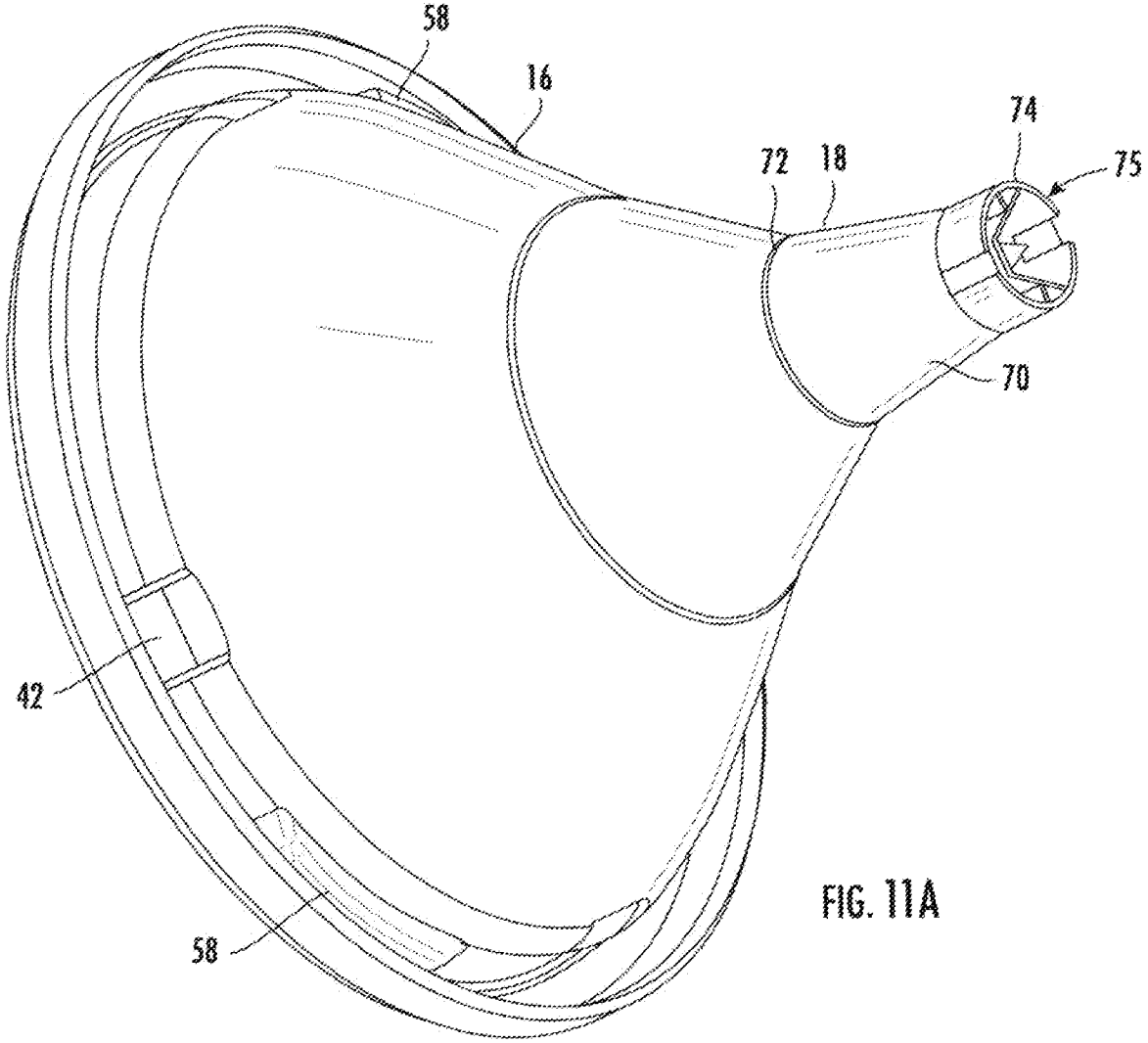
FIG. 11A is an alternative perspective view of the outer funnel member.
Figure 11B:
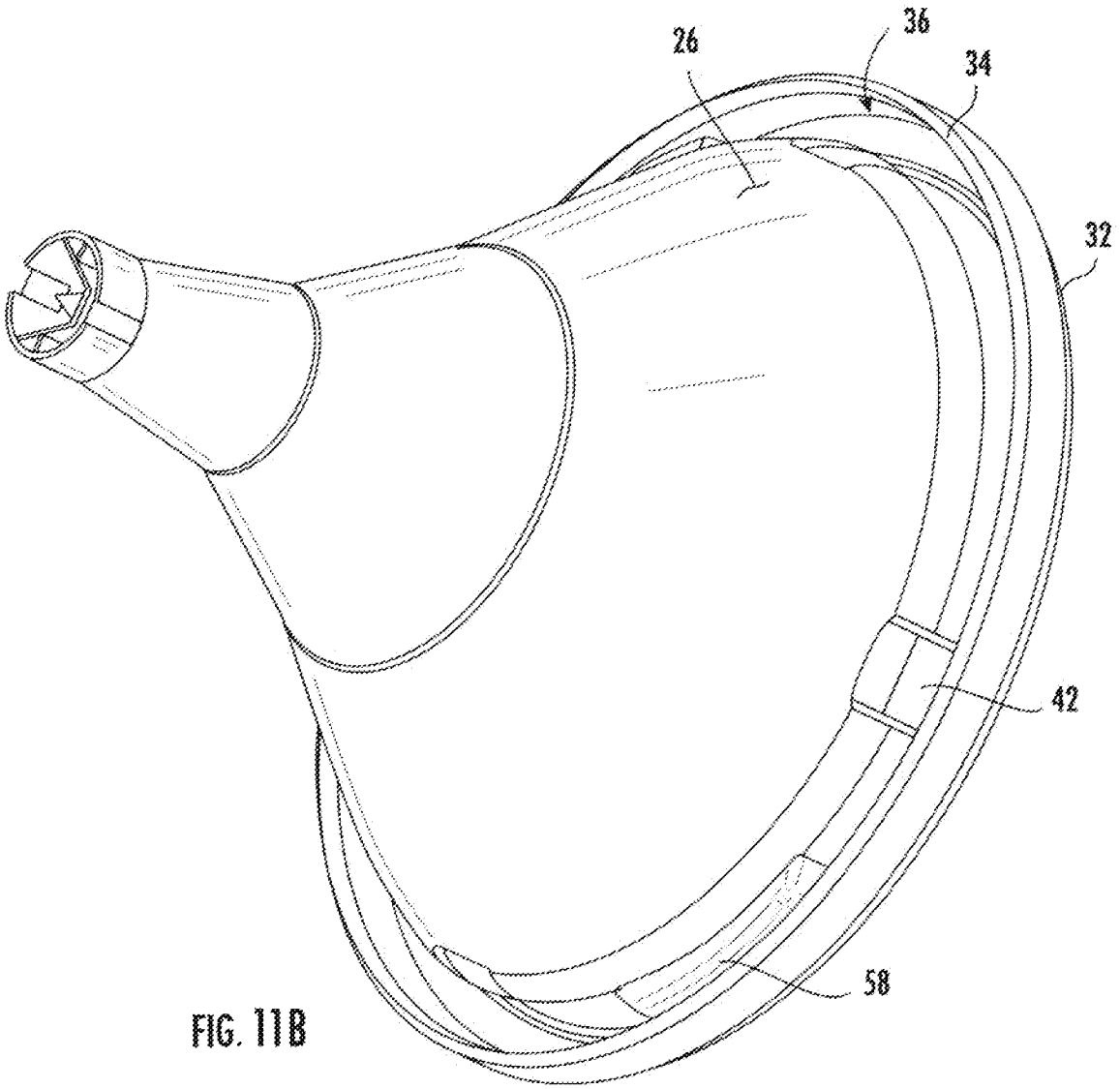
FIG. 11B is an alternative perspective view of the outer funnel member.

The outer funnel member stem portion 18 includes a main body 70 having an upper end 72 (where the top portion 16 ends merges into the stem portion 18) and a terminal end 74, see FIG. 11A, 11B. The terminal end 74 has an opening 75 sized and shaped to allow fluid to flow out therefrom. Positioned towards the terminal end 74, the outer funnel member stem portion 18 comprises one or more outer member stem portion venting members 76, illustrated as air ducts, see FIG. 15. The outer member stem portion venting members or air ducts 76 may be defined as a recessed wall or surface 78 enclosed by side walls 80 and 82, and an upper wall 84. The upper wall 84 comprises an opening 86, shown as a slot that extends through the outer member stem portion 18 and into an outer member stem portion inner area or lumen 88, allowing for air movement (see arrows 90, FIG. 14), i.e., enter/escape or vent into/out of the outer member stem portion 18. The opening 86 is set up into the upper wall 84 to allow for air flow (in or out), but prevent fluid flowing therethrough. As illustrated, the outer member stem portion 18 includes four (4) venting members or air ducts 76. Additional venting members or air ducts 76 may be used. Less than four venting members or air ducts 76 may be used. Some embodiments may include an outer member stem portion 18 having no venting members or air ducts 76.

Figure 8A:
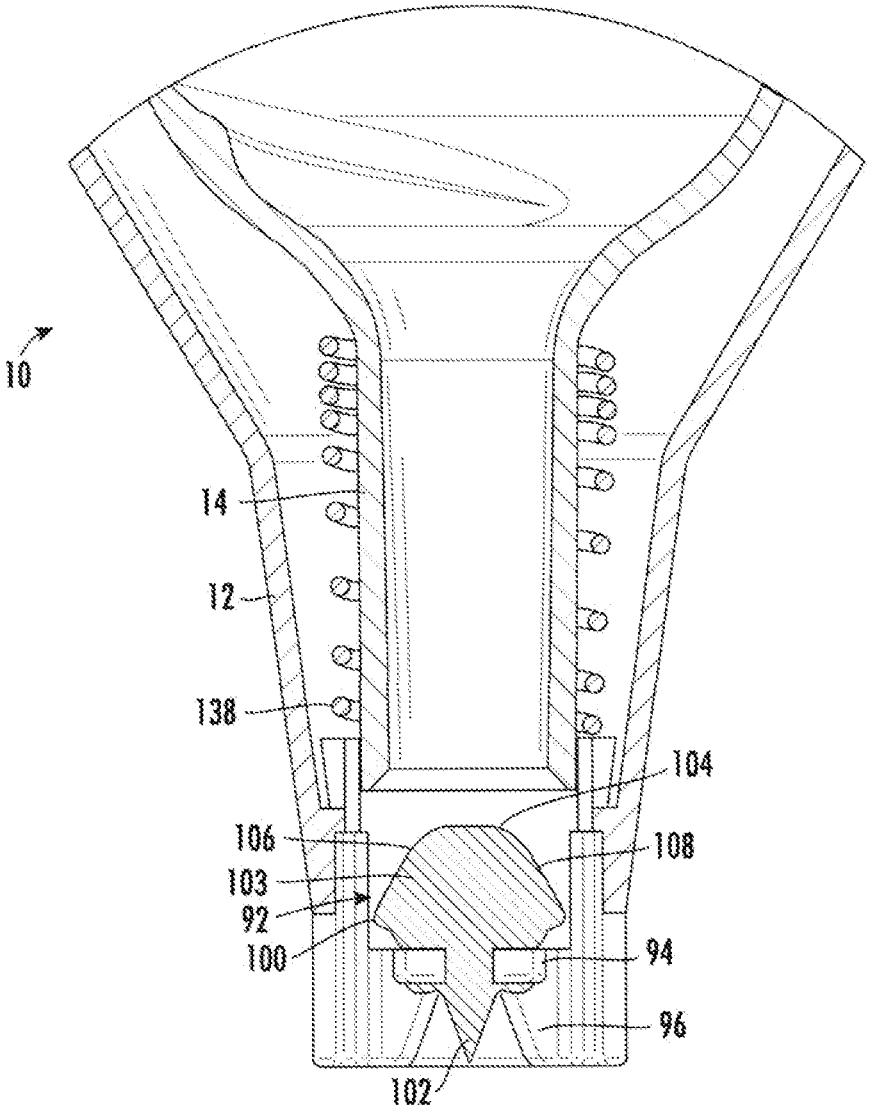
FIG. 8A is a partially enlarged view of lines 7-7, shown in FIG. 4, shown in a fluid flow orientation.
Figure 8B:
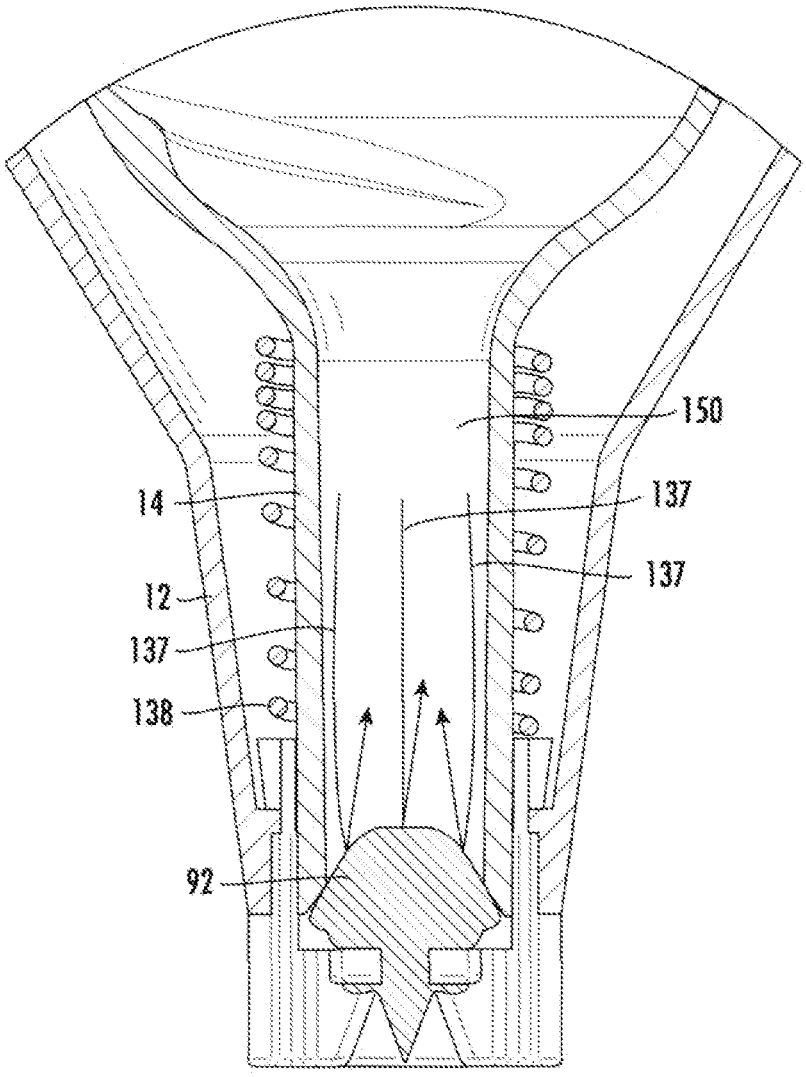
FIG. 8B is a cross-sectional view of the vented funnel with fluid flow stop, shown in a non-fluid flow orientation.
Figure 9:
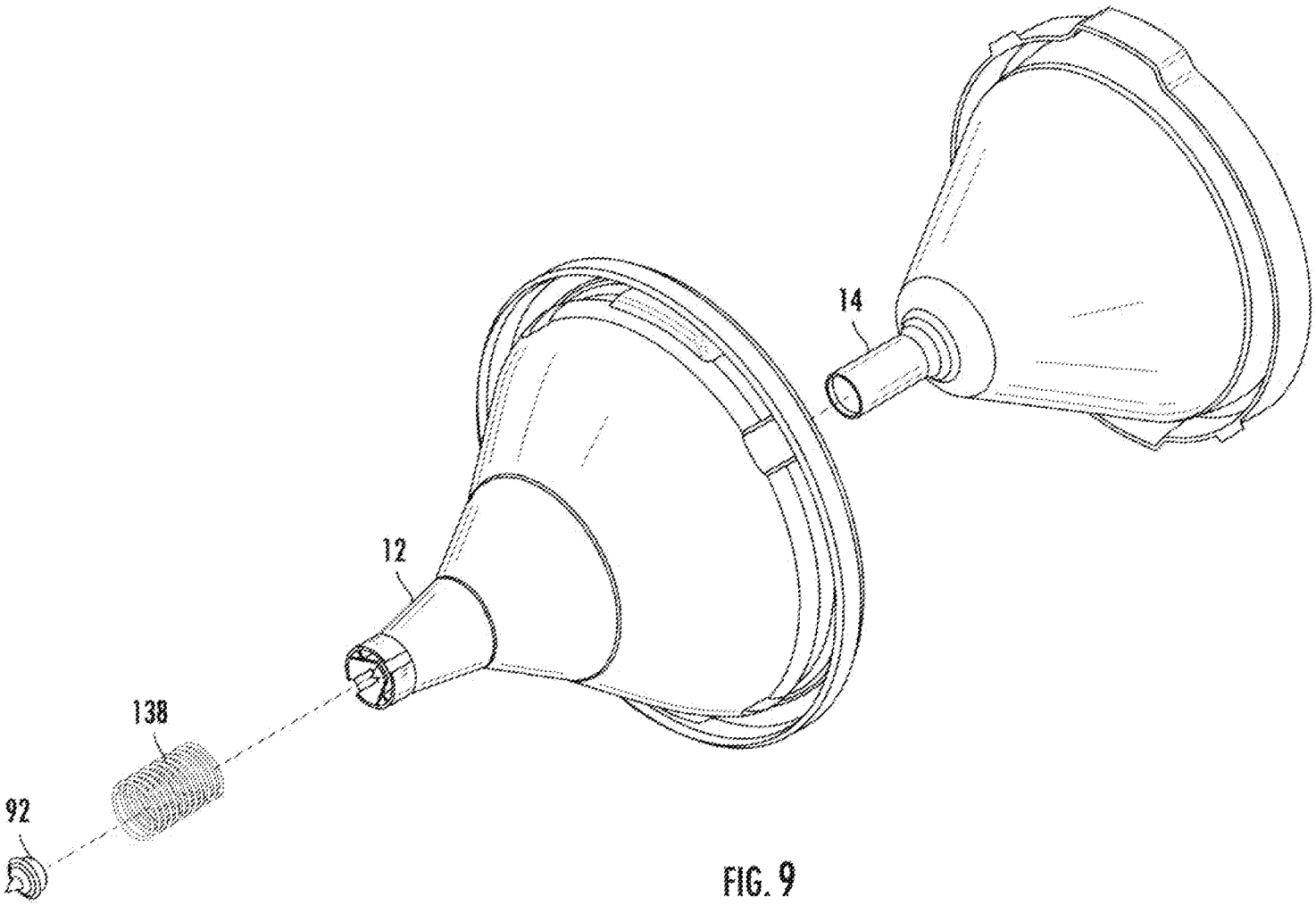
FIG. 9 is an exploded view of the vented funnel with fluid flow stop.
Figure 10:
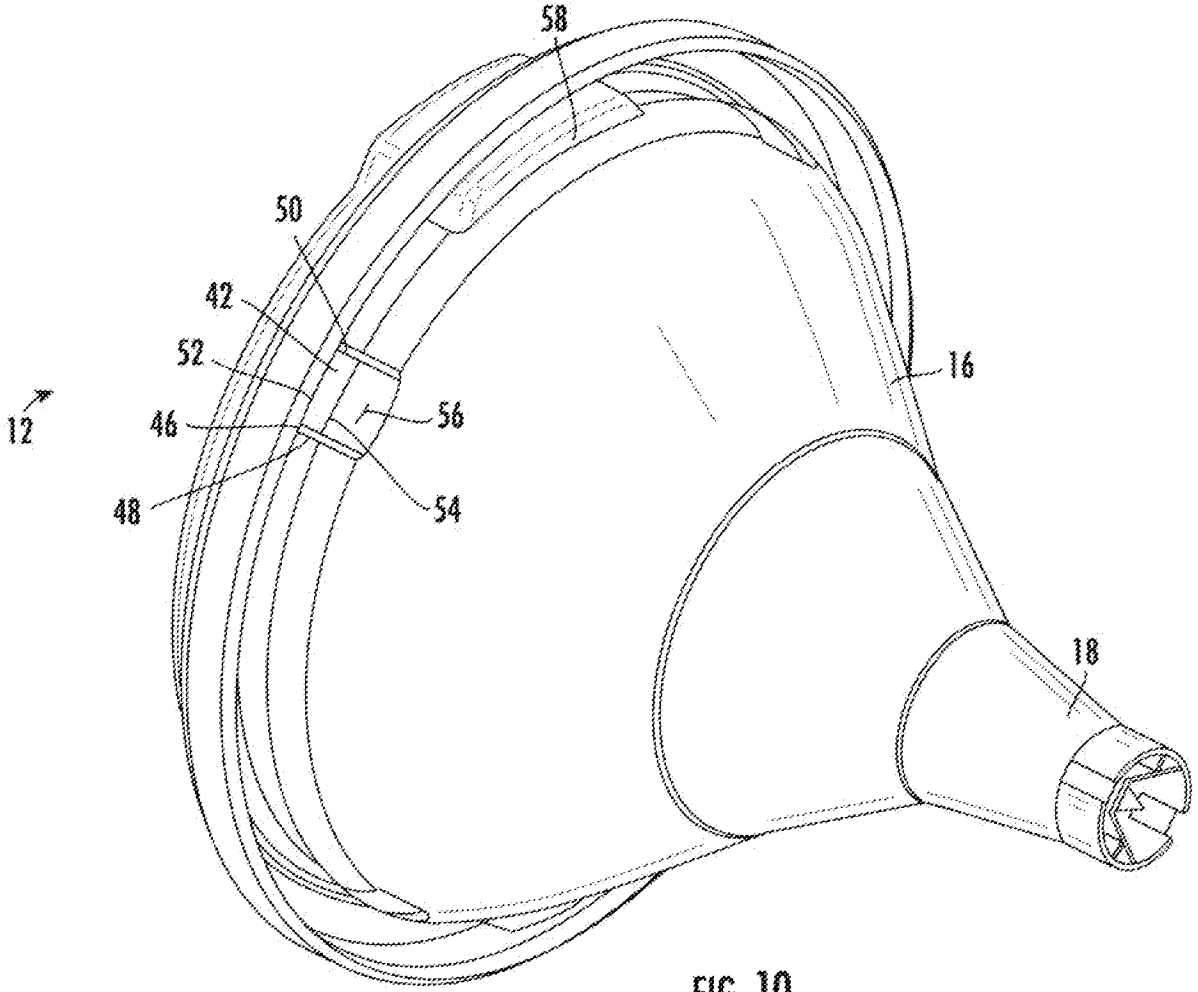
FIG. 10 is a perspective view of an illustrative embodiment of an outer funnel member.

To aid in fluid flowing and/or preventing fluid from flowing, the outer funnel member stem portion 18 may include a fluid sealing member 92, see FIGS. 8A, 8B and 9. The fluid sealing member 92 is configured to provide a mechanism to allow fluid to flow when the vented funnel with fluid flow stop 10 is in the fluid flow position, and to prevent fluid from flowing when the vented funnel with fluid flow stop 10 is in the non-fluid flowing position. The fluid sealing member 92 is shown suspended in the middle of the interior 88 of the outer member stem portion 18 by support structure 94, with ribbing 96. Surrounding each side of the fluid sealing member 92 is a plurality of apertures 98. The fluid sealing member 92 is shown having a cone like shape with an upper rounded section 100 and a smaller, lower tip bottom portion 102. The upper section 100 includes a body 103 having a top surface 104 with two diverging (extending away from the top surface 104), angled walls or surfaces 106 and 108. The two diverging walls or surfaces 106 and 108 provide ramped surfaces and a main body 103 having a larger diameter at the bottom or away from the upper surface 104. The ramped surfaces, therefore, provide guidance for the interaction between components of the outer member funnel 12 and the inner member funnel 14. This further allows a portion of the inner member funnel 12 to be tightly seal against the outer member stem portion 18 when fluid needs to be restricted (allowing the fluid to pool or be stored within the inner member funnel 14. Other shapes or configurations that allow for the same functionality may be used.

Referring to FIGS. 16-20, an embodiment of the inner funnel member 14 is shown. The inner funnel member 14 may be sized and shaped to mirror the shape of the outer funnel member 12, but smaller to allow the inner funnel member 14 to fit and rest within the outer funnel member 12. The inner funnel member 14 may include a top portion 110 and a stem portion 112. The top portion 110 includes a first end 114, a second opposing end 116, and a wall 118 therebetween having an outer surface 120 and an interior 122 having an inner surface 124 (see FIGS. 18 and 19). The interior 122 is configured to receive a fluid, hold a fluid, or allow a fluid to pass. The wall 118, which forms the top portion main 110 preferably has a tapering, from a larger section at the first end 114 to a smaller portion at the second opposing end 116. The shape of the wall 118 is designed to mirror portions of the outer funnel member 14, just smaller in size. Integrally formed or attached to the first end 114 is an edge or lip 125. The edge or lip 125 extends around the perimeter of the inner funnel member top portion 110. The top portion main 16 is shown having a conical shape, being wider at the edge or lip 125 and narrower at or near the outer funnel member stem portion 112. The edge or lip 125 may be formed having a folded over wall 126, see FIG. 17A, this forming a gap 128 between the wall 126 and the outer surface 120. The width Doe, see FIG. 18, of the edge or lip 125 may define an outer diameter 130 (with outer perimeter) and an inner diameter 132 (with inner perimeter). The inner funnel member top portion 110 is designed to be larger, i.e. have a larger diameter, than the inner funnel member stem portion 112.

As described previously, the inner funnel member 14 rests and moves within the outer funnel member 12. To aid configuration, positioned on or along the edge or lip 125, are the one or more outer member engagement members 44, see for example, FIG. 16, 17A, 17B, or 19. The one or more outer member engagement members 44 are arranged on or along the edge or lip 125 so that when the inner funnel member 14 is positioned within the outer member funnel 12, the one or more outer member engagement members 44 align with and are placed within the one or more inner member engagement members 42. In an illustrative embodiment, the one or more outer member engagement members 44 is an elongated body or protuberance 134 (FIG. 16) that extends out from the edge or lip 125 (preferably the edge or lip of the folded over wall 126). The elongated body 134 is sized to fit within the distance between inner member engagement members opposing side walls 48 and 50. The elongated body 134 may also extend from the edge or lip 125 a sufficient distance, so that when the elongated body 134 is moved up/down, it maintains contact with the inner member engagement members top wall 52 or opposing bottom wall 54, this keeping them within the inner member engagement members 42.

Within the inner funnel member top portion 110, preferably positioned within the edge or lip 125 (preferably the edge or lip of the folded over wall 126) are fluid stop tabs 136. As shown, the top portion 110 contains two fluid stop tabs 136, positioned about 180 degrees from each other. While two fluid stop tabs 136 are shown, one or more than two may be used. The fluid stop tabs 136 are sized and shaped to have a congruent shape, as that of the one or more secondary inner member engagement members 58. Accordingly, when in use, the fluid stop tabs 136 fit or rest within, in a manner that allows the two fluid stop tabs 136 to move up or down. By pushing down on the fluid stop tabs 136, the inner funnel member 14 gets pushed into the outer funnel member 12, cutting off fluid flow (non-fluid flow position, see FIG. 8B, arrows 137 indicating fluid flow not being able to exit (pooling or being stored therein) out the openings of the vented funnel with fluid flow stop 10). A spring 138, positioned around the inner funnel member stem portion 112, see FIG. 8A, allows the inner funnel member 14 to return to the first (fluid flow position) position after the force applied to the fluid stop tabs 136 is removed. In this orientation, fluid flows out of the vented funnel with fluid flow stop 10 (through, for example apertures 98).

Figure 7:
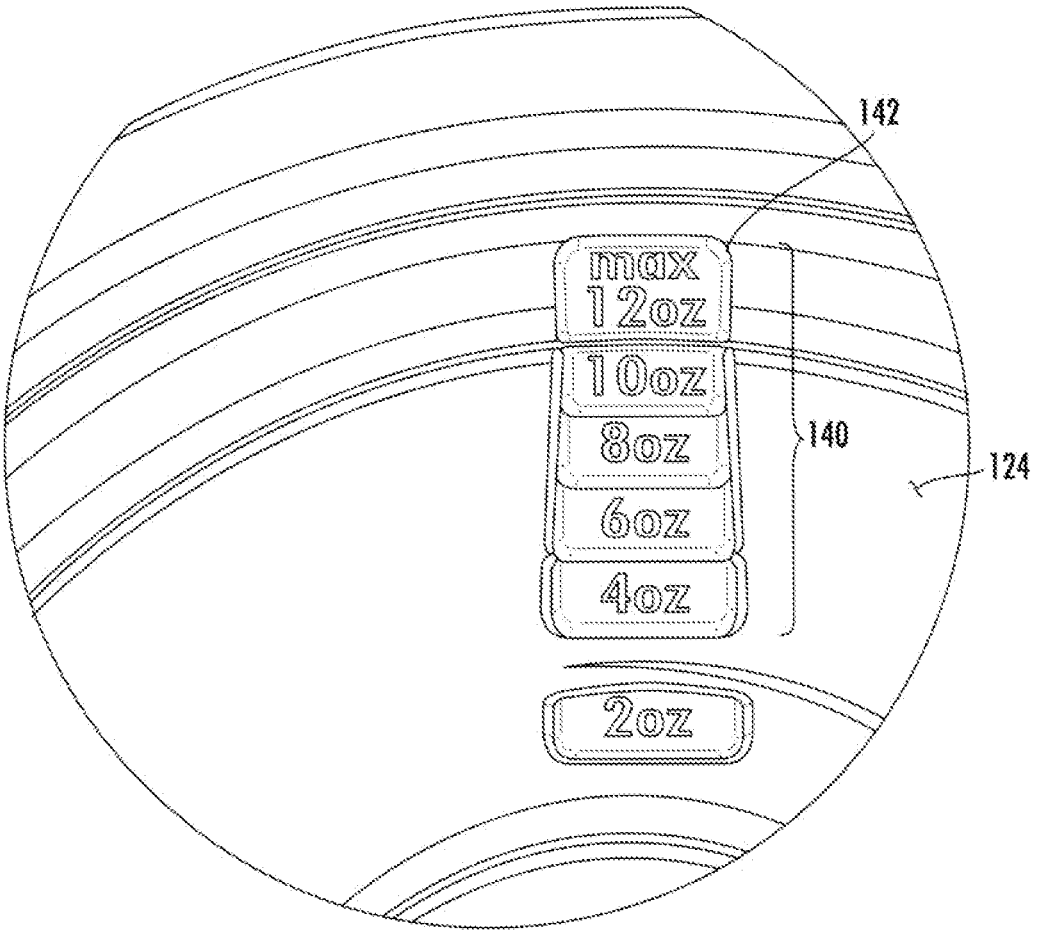
FIG. 7 is a close-up view of an interior surface of the vented funnel with fluid flow stop.
Figure 18:
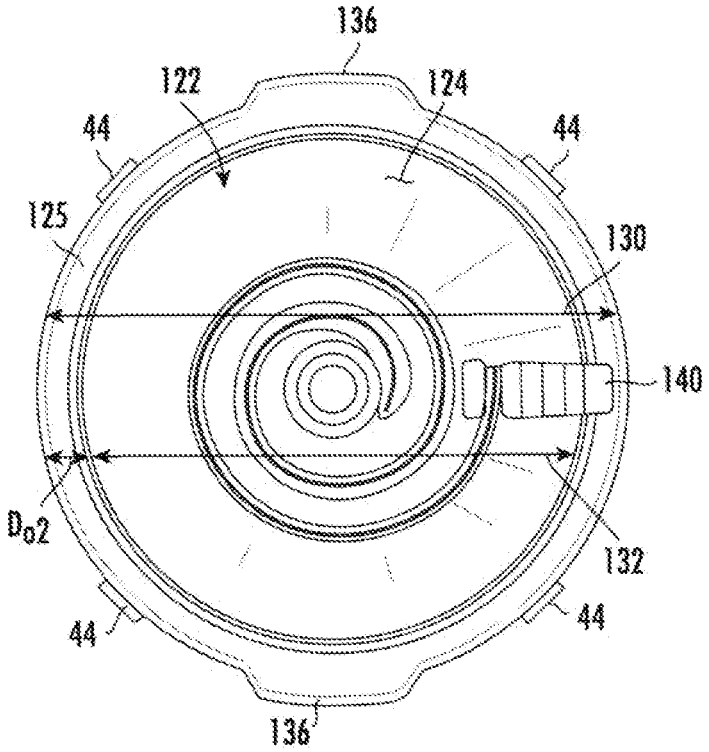
FIG. 18 is a top view of the inner funnel member.
Figure 19:
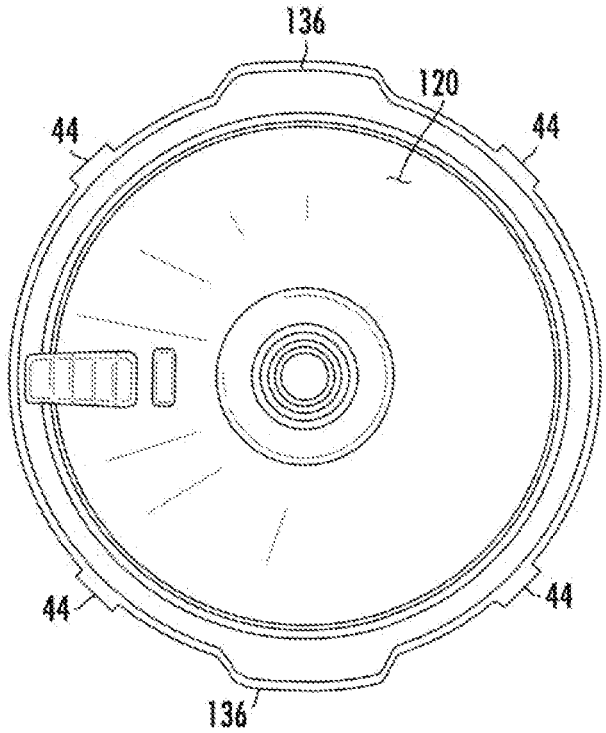
FIG. 19 is a bottom view of the inner funnel member.
Figure 20:
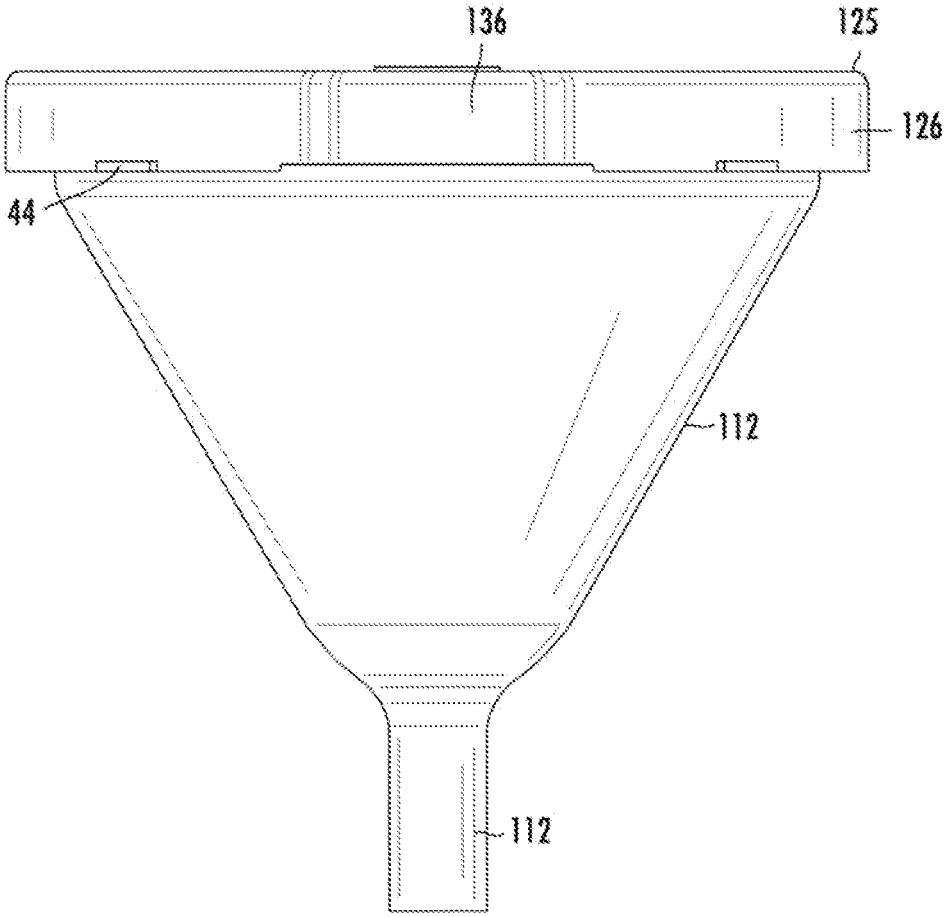
FIG. 20 is a side view of the inner funnel member.

The interior 122 of the inner funnel member top portion, particularly the inner surface 124, may include fluid level indicators 140, see FIG. 7 and FIG. 18. The fluid level indicators 140 are shown as individual ledges 142 that indicate when the fluid level within the inner funnel member 14 is 2, 4, 6, 8, 10, or 12 ounces. Other indicators, such as notches or lines, may be used as well.

Figure 16:
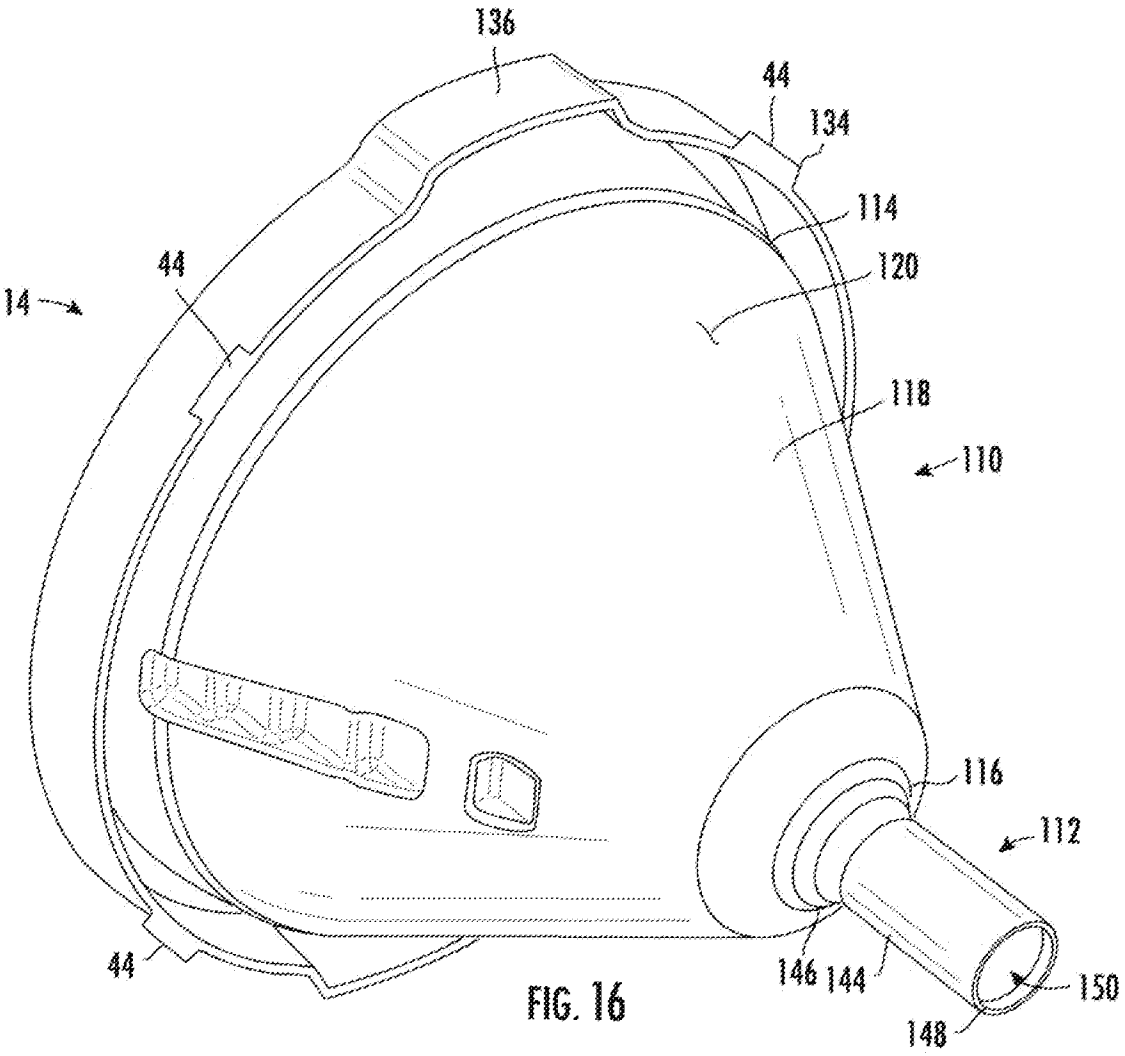
FIG. 16 is a perspective view of an illustrative embodiment of an inner funnel member.
Figure 17A:
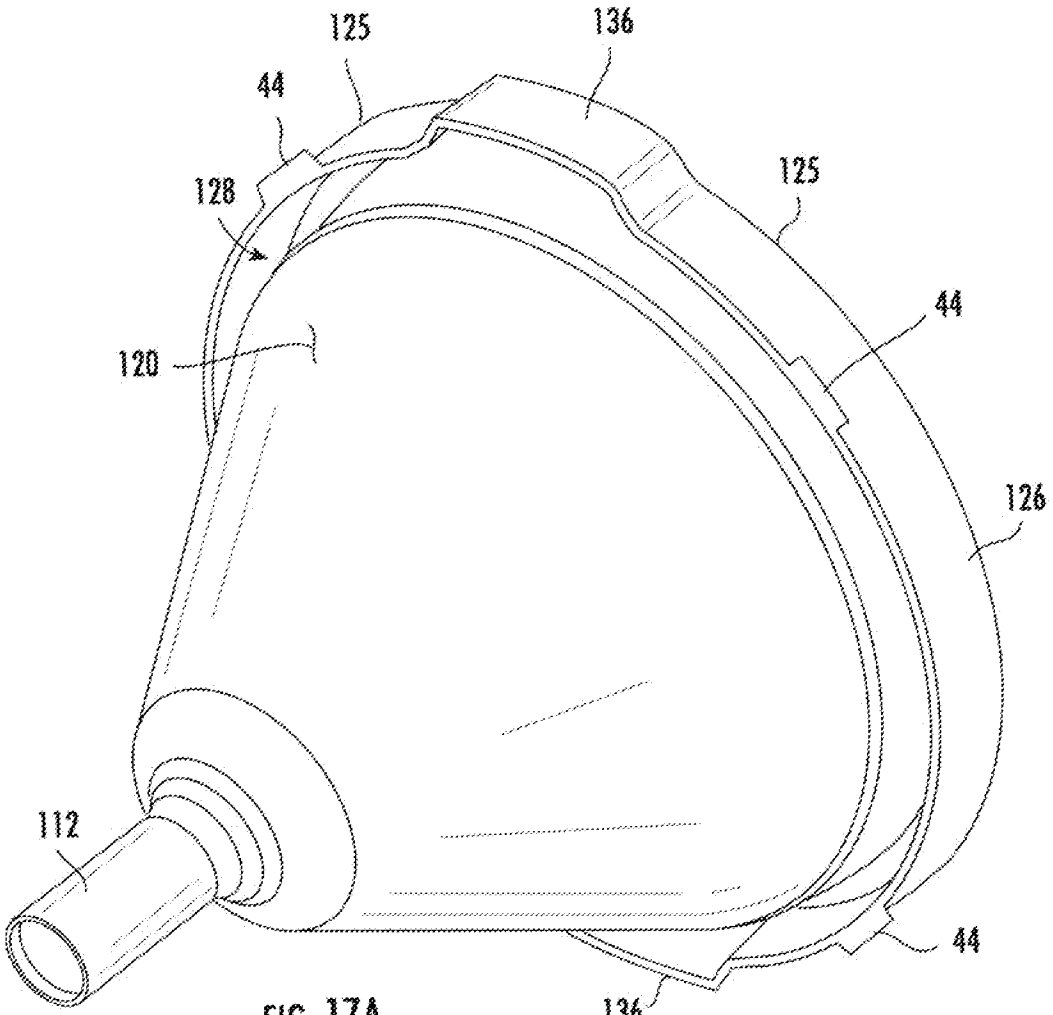
FIG. 17A is an alternative perspective view of the inner funnel member.
Figure 17B:
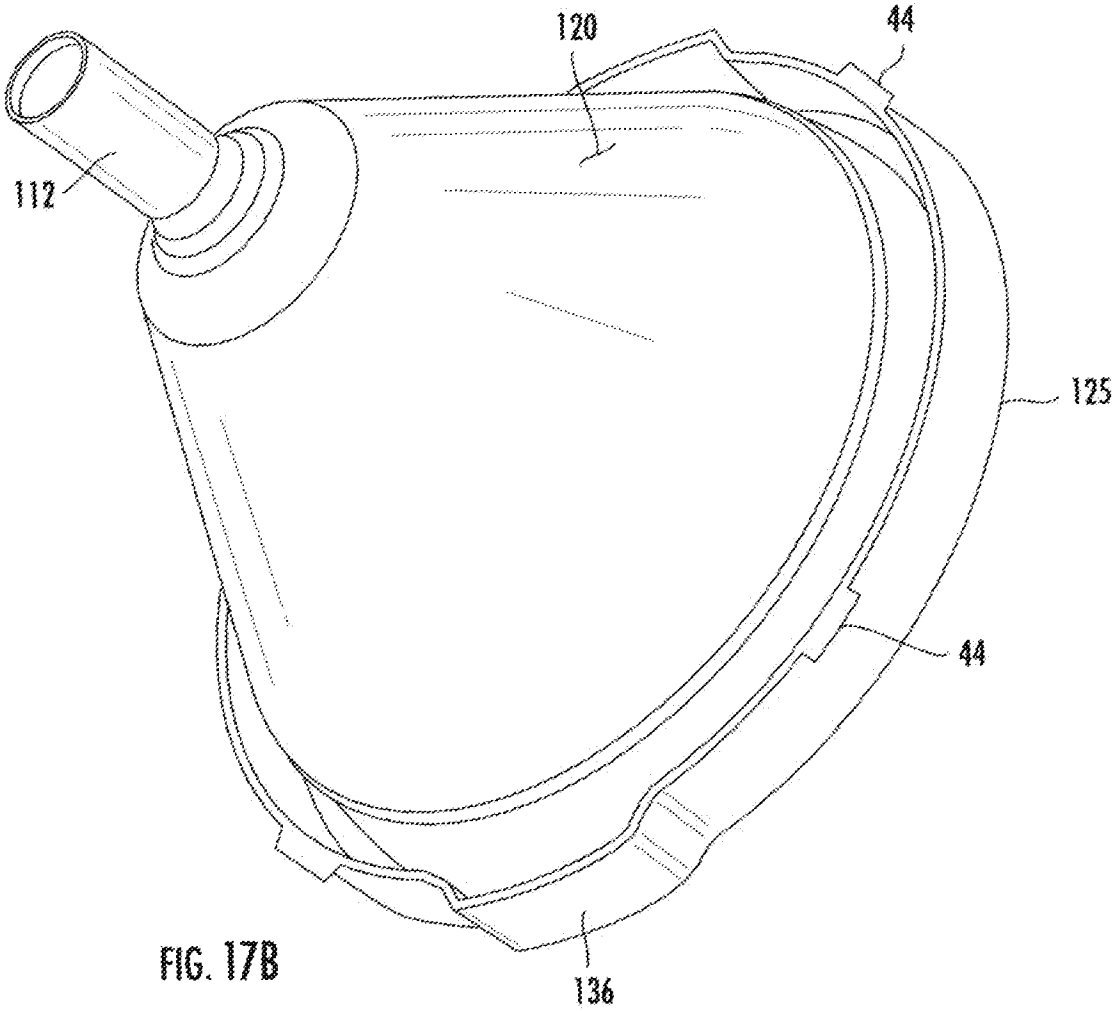
FIG. 17B is an alternative perspective view of the inner funnel member.

The inner funnel member stem portion 112 includes a main body 144 having an upper end 146 (where the top portion 110 merges into the stem portion 112) and a terminal end 148, see FIG. 16. The terminal end 148 has an opening 150 sized and shaped to allow fluid to flow out therefrom. The diameter of the stem portion 112 should be sufficient in size to receive at least a portion of the fluid sealing member 92. Accordingly, when a sufficient portion of the fluid sealing member 92 is inserted into the inner funnel member stem portion 112 and sealed therein, fluid is prevented from travelling from the inner funnel member interior 122, through the inner funnel member stem portion 112, and out.

Figure 21:
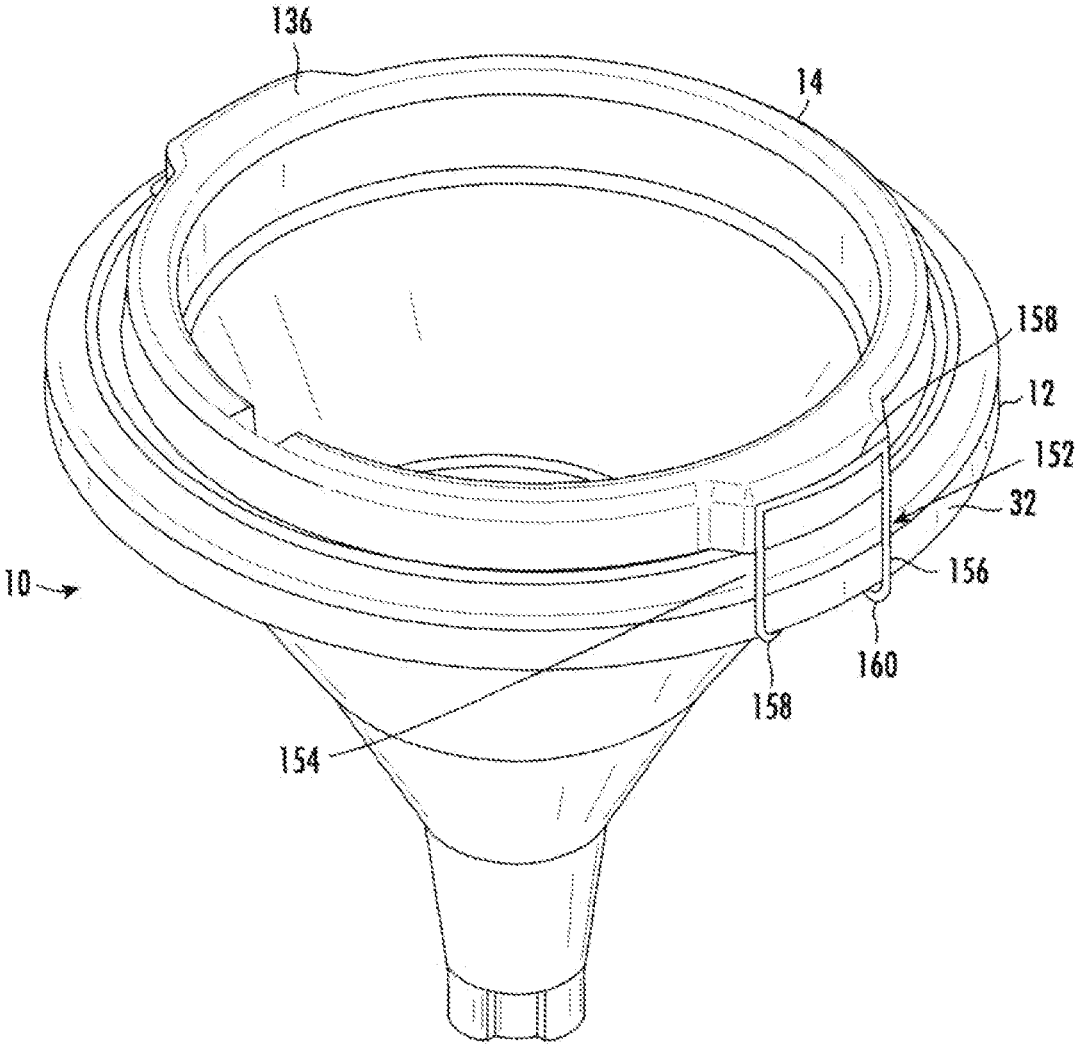
FIG. 21 is a perspective view of the vented funnel with fluid flow stop, shown with a locking mechanism.
Figure 22:
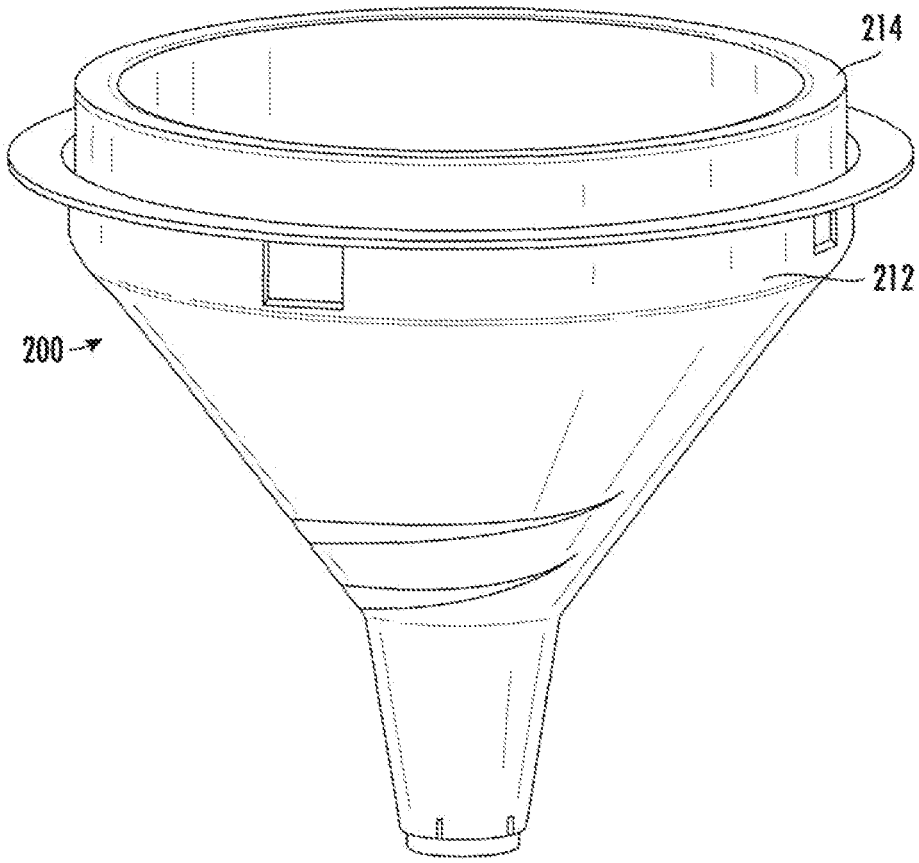
FIG. 22 is a perspective view of an illustrative example of a vented funnel with fluid flow stop, shown in the fluid flow position.
Figure 23:
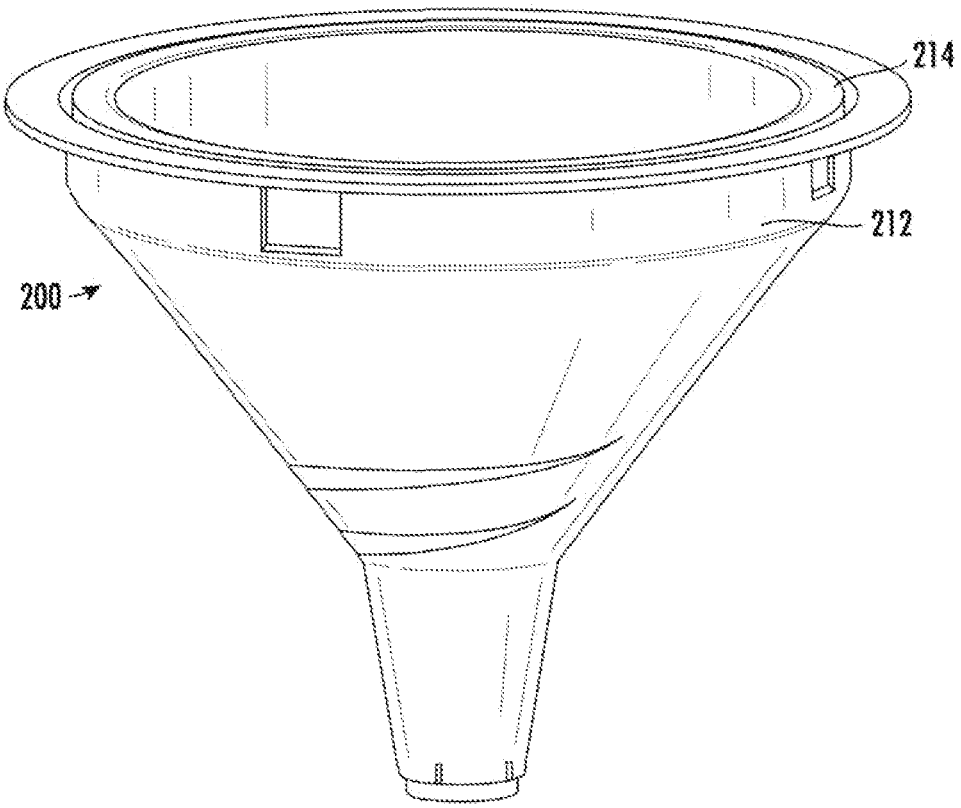
FIG. 23 illustrates the vented funnel with fluid flow stop shown illustrated in FIG. 22, in the non-fluid flow position.

FIG. 21 illustrates the vented funnel with fluid flow stop 10 with a locking member 152. The locking member 152 may comprise a pair of arms 154 and 156, spaced apart by a support structure 158. The locking member 152 may be attached to the vented funnel with fluid flow stop 10. In operation, when a user pushes down on the inner funnel member 14, causing the fluid flow to stop, the arms 154 and 156 can be locked onto the bottom of the edge or lip 32 by attaching the hooked shaped ends, 158, 160, thereto. This prevents the inner funnel member to move within the outer funnel member 12. To allow for fluid to flow, the user can unhook arms 154 and 156, allowing the inner funnel member 14 to move within the outer funnel member 12. Although the use of arms 154 and 156 form the locking member, other devices, such as the use of a pin, knobs and screws, buttons, to lock and unlock the two units together known to one of skill may be used.

Referring to FIGS. 22-31, an illustrative example of a funnel, referred to herein as a vented funnel with fluid flow stop 200, is shown. The vented funnel with fluid flow stop 200 has many of the same features as the vented funnel with fluid flow stop 10, and has the same functionality, 1) to provide for more even fluid flow, 2) to maximize fluid flow, and 3) to prevent fluid flow when needed. The vented funnel with fluid flow stop 200 comprises an outer funnel member 212 and an inner funnel member 214, the inner funnel member 214 configured to fit within the outer member funnel member 212. The vented funnel with fluid flow stop 200 may be configured to allow fluid flow, referred to herein as a first, or fluid flow position, see FIG. 22, or to prevent fluid flow, referred to herein as a second, or non-fluid flow position, see FIG. 23.

Figure 24:
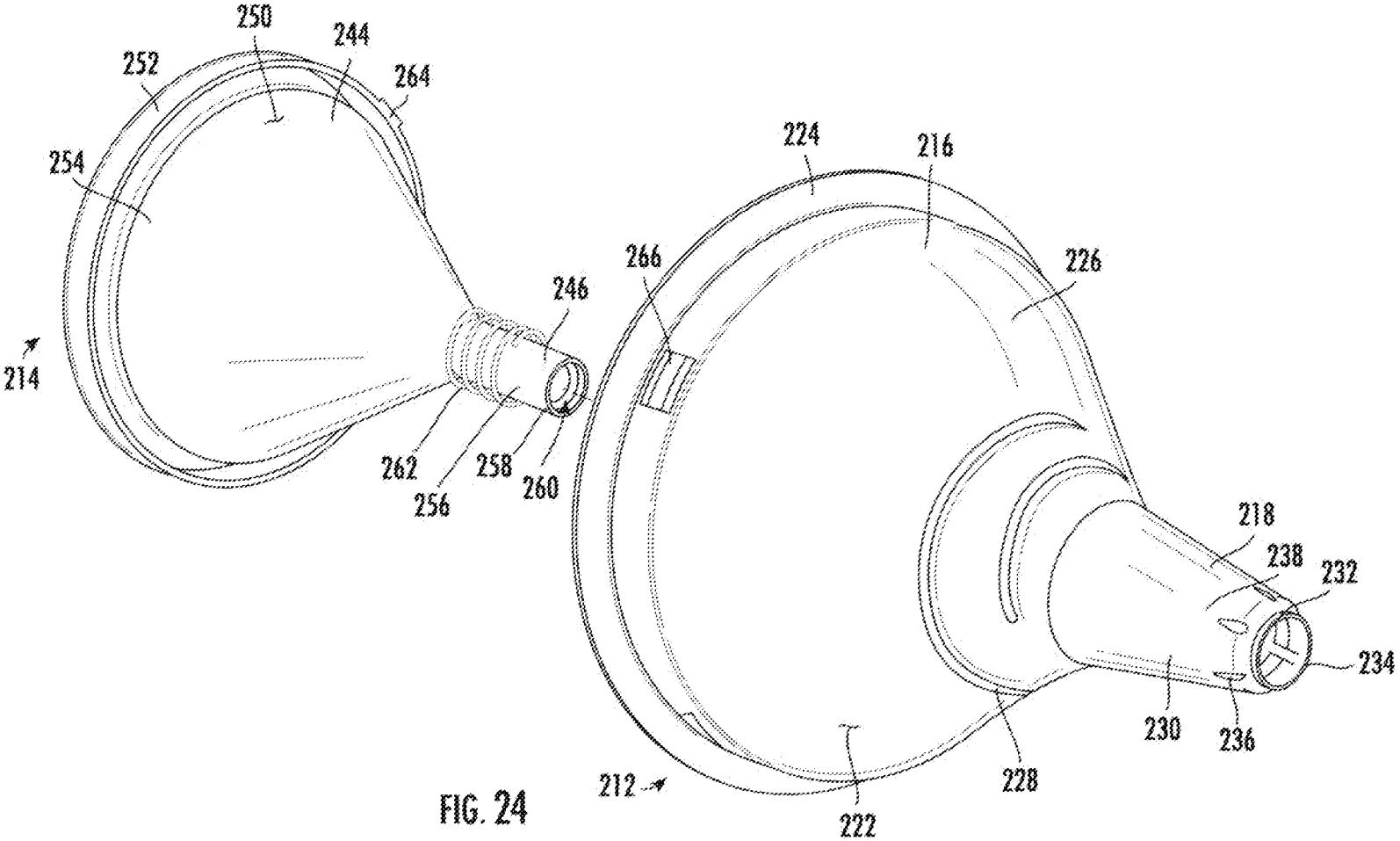
FIG. 24 illustrates an exploded view of the vented funnel with fluid flow stop illustrated in FIG. 22.
Figure 25:
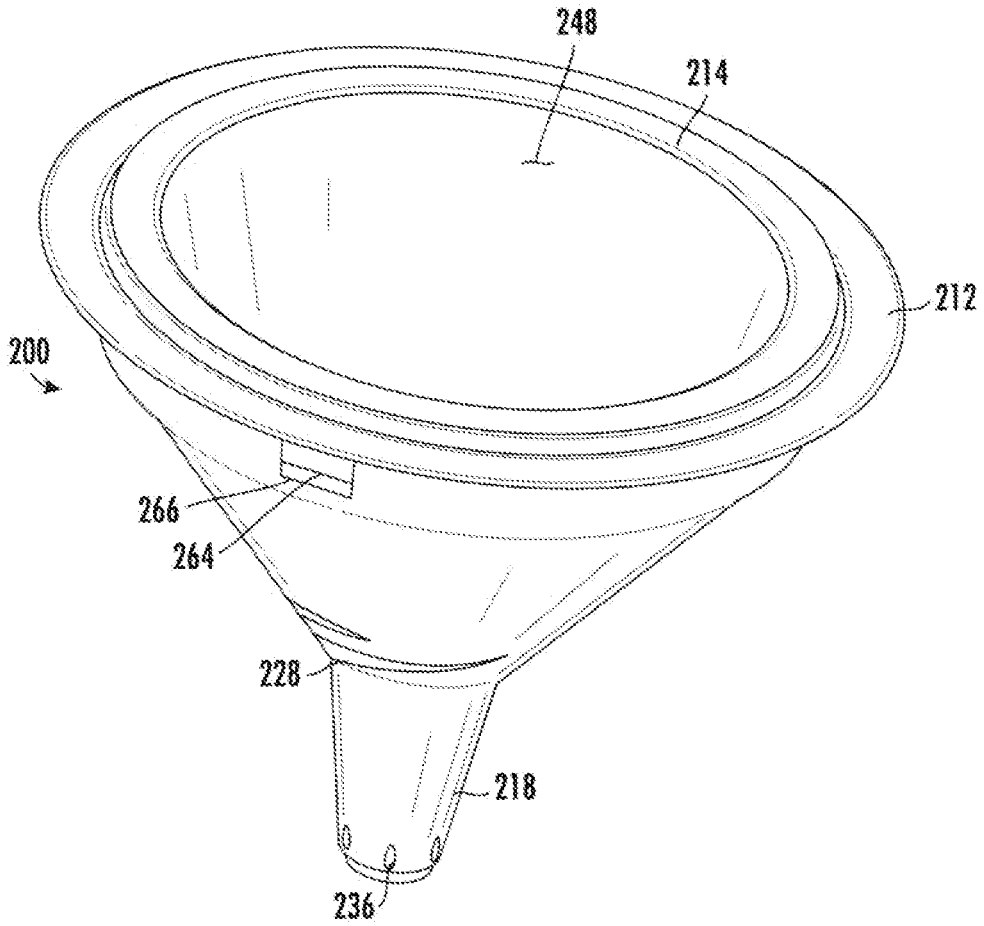
FIG. 25 is an alternative view of the vented funnel with fluid flow stop illustrated in FIG. 22.
Figure 26:
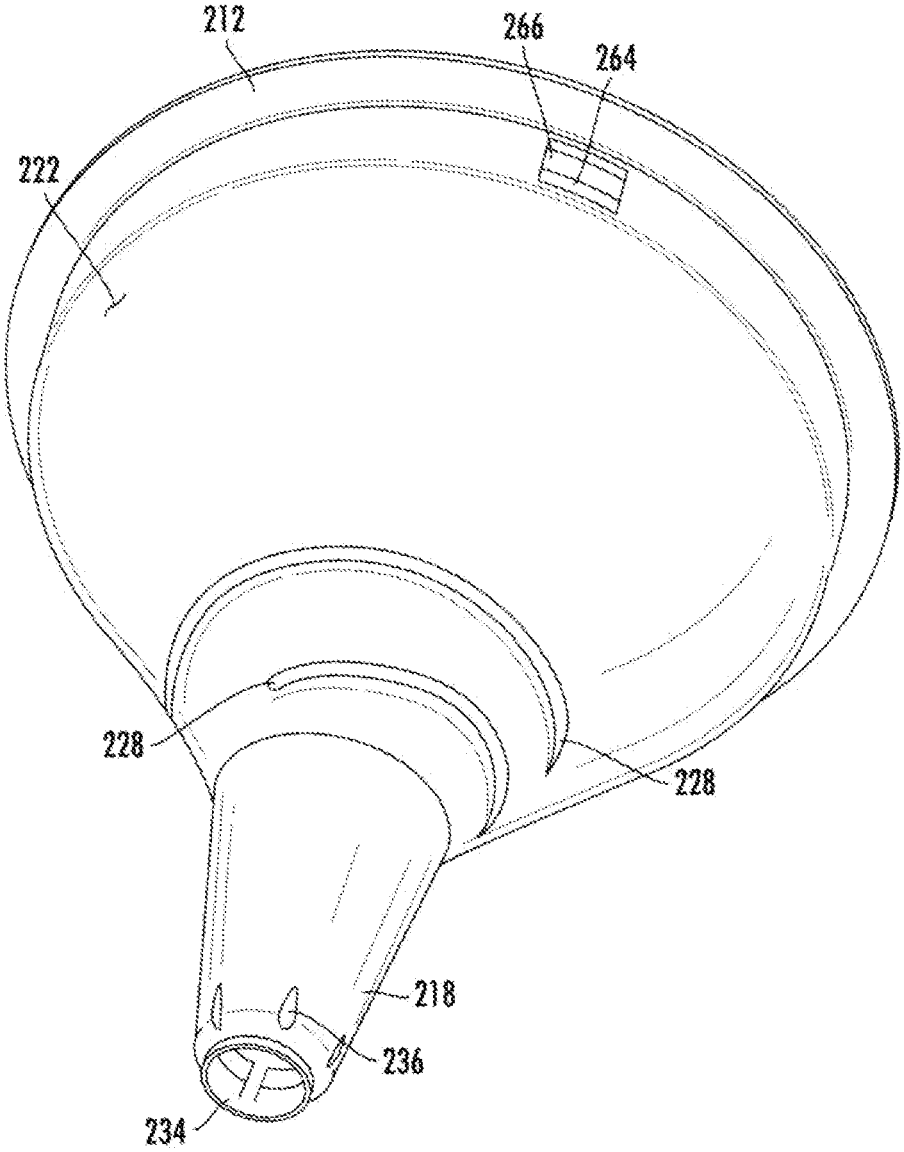
FIG. 26 is an alternative view of the vented funnel with fluid flow stop illustrated in FIG. 22.
Figure 27:
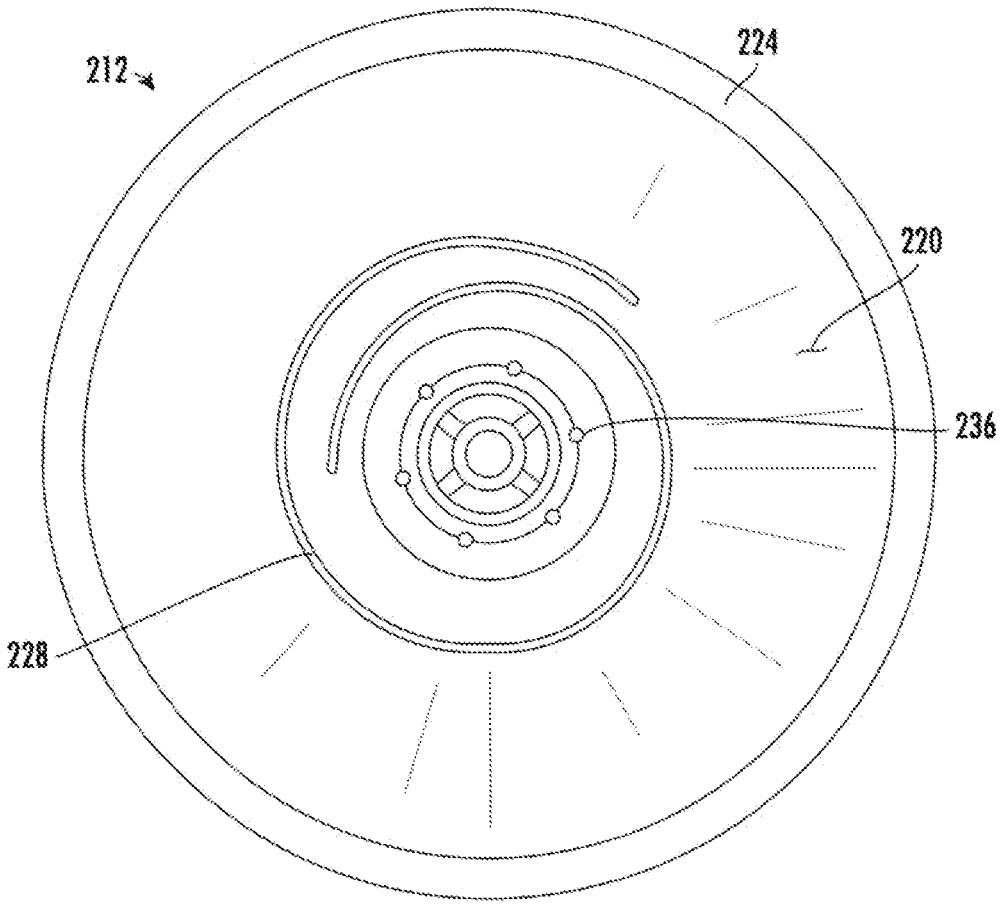
FIG. 27 is a top view of the vented funnel with fluid flow stop illustrated in FIG. 22, shown with the inner fluid member removed.
Figure 28:
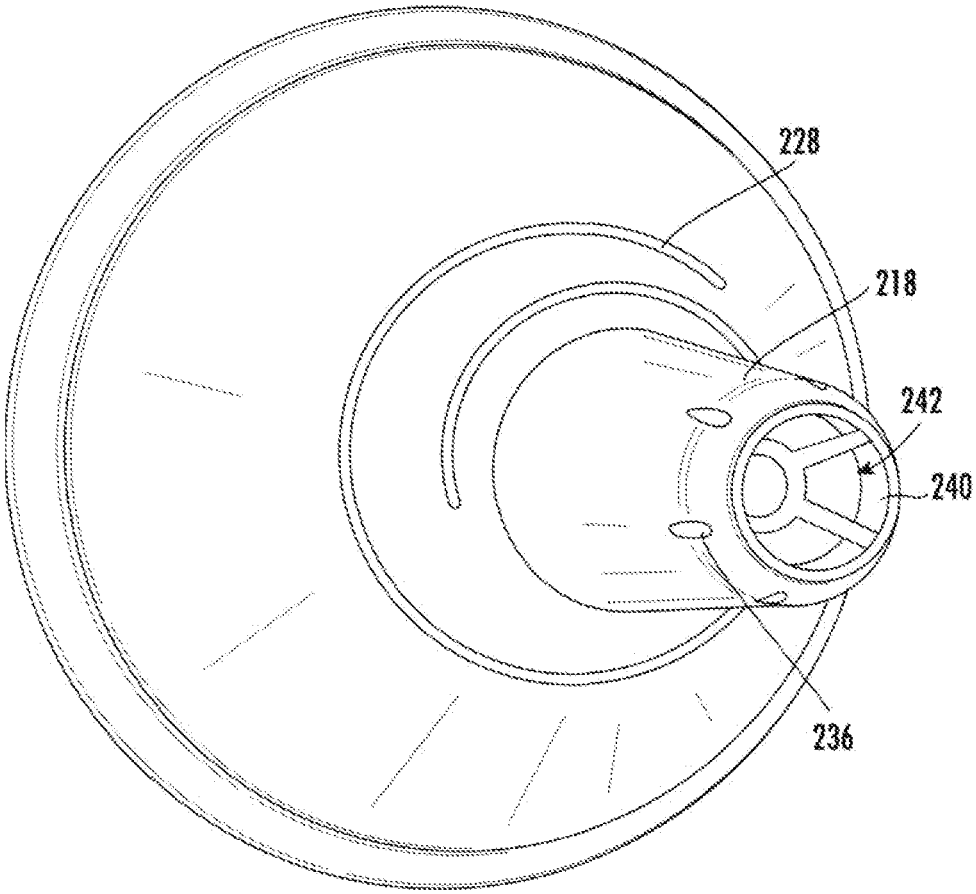
FIG. 28 is a bottom view of the vented funnel with fluid flow stop illustrated in FIG. 22.
Figure 29:
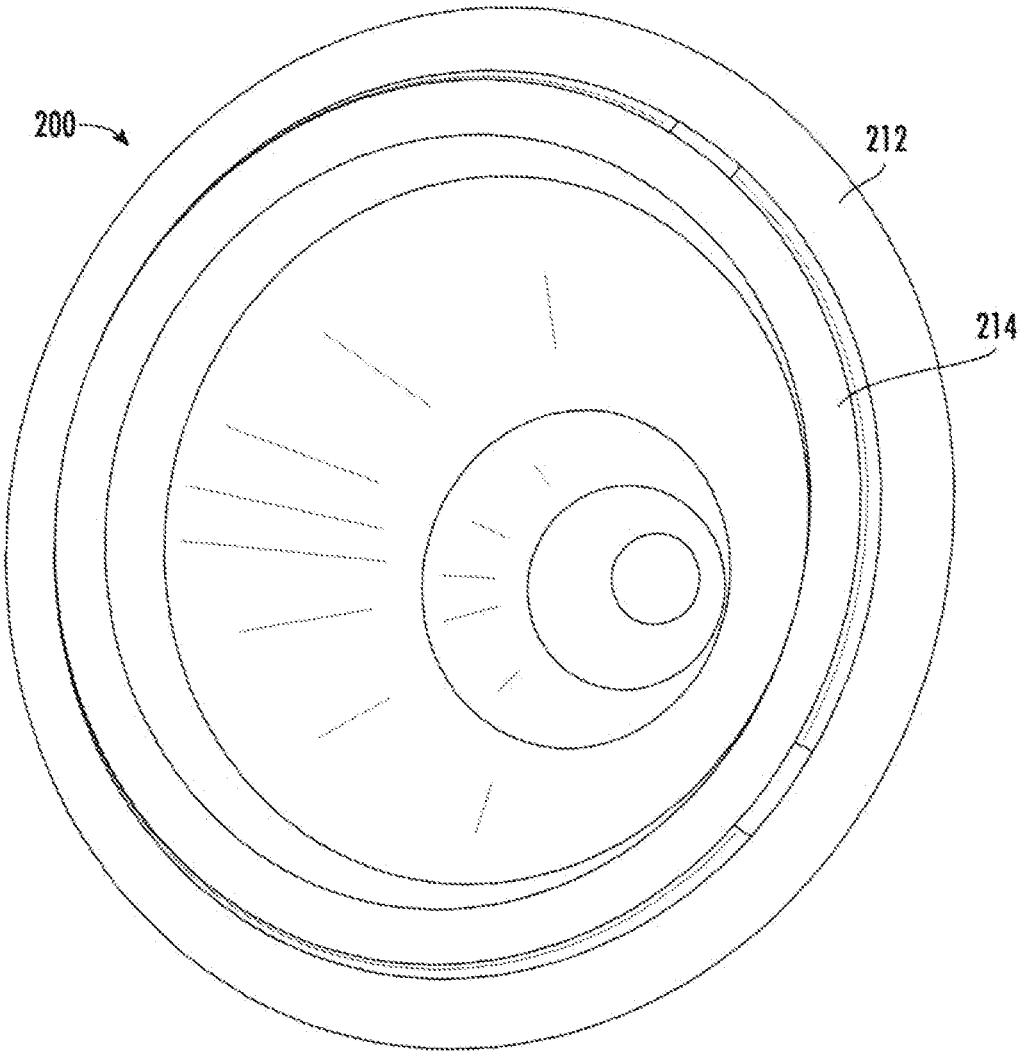
FIG. 29 is a top view of the vented funnel with fluid flow stop illustrated in FIG. 22, illustrating the interior portion of the inner funnel member.
Figure 30A:
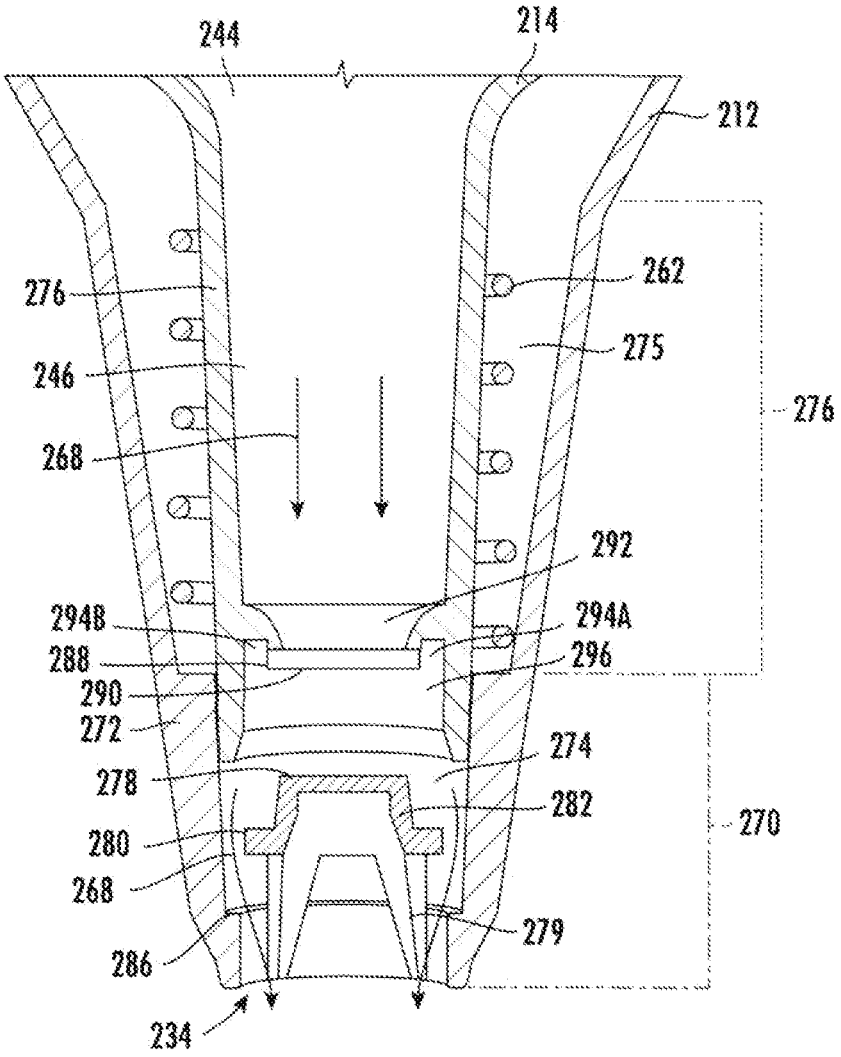
FIG. 30A is a cross-section of the vented funnel with fluid flow stop illustrated in FIG. 22, shown in the fluid flow position.
Figure 30B:
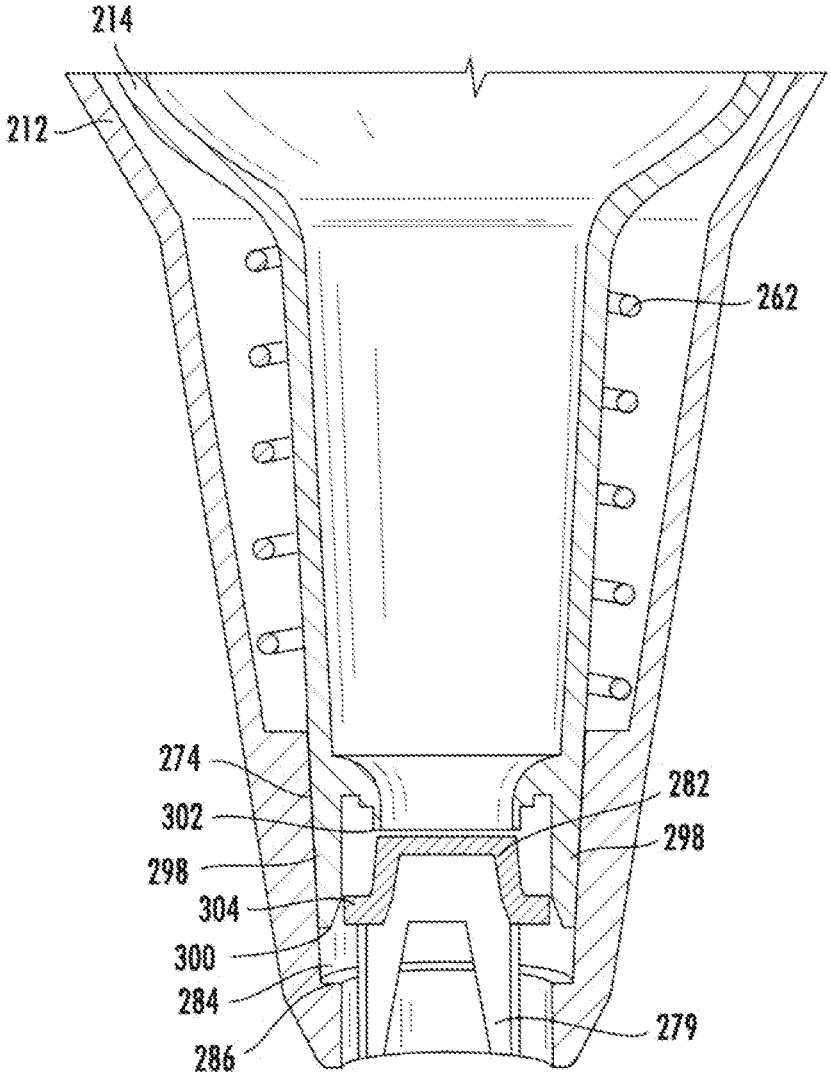
FIG. 30B is a cross-section of the vented funnel with fluid flow stop illustrated in FIG. 22, shown in the non-fluid flow position.

Referring to FIG. 24, the outer funnel member 212 may include a top portion 216 and a stem portion 218, with the outer funnel member top portion 216 being larger than the outer funnel member stem portion 218. The outer funnel member 212 has an interior surface 220, see FIG. 27, and an exterior surface 222. The outer funnel member top portion 216 comprises a lip 224 and a main body 226 having a conical shape, being wider at the lip portion 224 and narrower near the outer funnel member stem portion 218. The lip portion 224 extends around the perimeter of the outer funnel member top portion 216. Near the outer funnel member stem portion 218, outer funnel member exterior surface 222 contains one or more upper portion venting members 228, illustrated herein as channels. The one or more upper portion venting members 228 extend through the exterior surface 222 and the interior surface 220, and are configured to potentially provide a mechanism for allowing trapped air within the vented funnel with fluid flow stop 200 to be expelled. The one or more upper portion venting member channels 228 are illustrated as a single spiral that extends around the outer funnel member exterior surface 222, see for example FIGS. 22 and 26. The one or more upper portion venting member channels 228 may be configured to extend all the way to the top of the outer funnel member top portion 216, and/or into the outer funnel member stem portion 218, or anywhere in between.

The outer funnel member stem portion 218 includes a main body 230 and a terminal end 232 having an opening 234 sized and shaped to allow fluid to flow out therefrom. Positioned towards the terminal end 232, the outer funnel member stem portion 218 comprises one or more outer member stem portion venting members 236, illustrated as openings or slots that extend through the outer member stem portion outer surface 238 and into the outer member stem portion inner surface 240, see FIG. 28, allowing air to escape or vent from the outer member stem portion interior 242.

The inner funnel member 214 may be sized and shaped to mirror the shape of the outer funnel member 212, but smaller to allow the inner funnel member 214 to fit and rest within the outer funnel member 212. The inner funnel member 214 may include a top portion 244 and a stem portion 246, with the inner funnel member top portion 244 being larger than the inner funnel member stem portion 246. The inner funnel member 214 has an interior surface 248, see FIG. 25, and an exterior surface 250. The inner funnel member top portion 244 may comprise an outer wall 252 that extends around the perimeter and a main body 254 having a conical shape, being wider at the outer wall 252 and narrower near the inner funnel member stem portion 246. The inner funnel member stem portion 246 includes a main body 256 and a terminal end 258 having an opening 260 sized and shaped to allow fluid to flow out therefrom. The inner funnel member stem portion 246 may include a spring 262 to aid in the transition of the vented funnel with fluid flow stop 200 from the first, fluid flow position to the second, non-fluid flow position, or from the second, non-fluid flow position to the first, fluid flow position. The inner funnel member 214 may include a first portion of an inner funnel member to outer funnel member locking member 264, illustrated herein as a tab or protuberance. The first portion of an inner funnel member to outer funnel member locking member 264 is sized and shaped to fit and lock within a second portion of an inner funnel member to outer funnel member locking member 266, illustrated herein as an open notch or slot in the outer funnel member 212. When the first portion of an inner funnel member to outer funnel member locking member 264 is pushed or placed into the second portion of an inner funnel member to outer funnel member locking member 266, the inner funnel member 214 is locked in place against or to the outer funnel member 212.

The vented funnel with fluid flow stop outer funnel member stem portion 218 comprises a first portion of the fluid flow prevention mechanism, which is defined to interact with the second portion of the fluid flow mechanism located within the fluid flow stop inner funnel member stem portion 246.

The outer funnel member stem portion 218 comprises a first portion of a fluid flow prevention mechanism, which is configured to interact with the second portion of the fluid flow mechanism located within the inner funnel member stem portion 246. When not interacting, fluid is allowed to flow through the inner funnel member top portion 244, into the inner funnel member stem portion 246, and out from the outer portion opening 234, see arrows 268, FIG. 30A. The bottom portion 270 of the outer funnel member stem portion 218 may comprise a walled section 272 defining a fluid flow prevention mechanism interior or channel 274; the flow prevention mechanism interior or channel 274 being smaller than the rest of the interior 275 of the upper portion 276 of the outer funnel member stem portion 218. The diameter of the fluid flow prevention mechanism interior or channel 274 is sized to receive at least a portion of the inner funnel member stem portion 246. The walled section 272 may be angled or have a taper to guide the outer funnel member stem portion 218 in place. Positioned within the fluid flow prevention mechanism interior or channel 274 is a fluid flow stop 278. The fluid flow stop 278, which may be supported by ribs 279, comprises an outer rim 280 and a main body 282 sized and shaped to interact with a portion of the second portion of the fluid flow mechanism located within the inner funnel member stem portion 246. The outer rim 280 has a diameter that extends outwardly to form a guide channel 284, allowing a portion of the inner funnel member stem portion 246 to fit therein, and stop once it hits a shoulder stop 286.

The second portion of the fluid flow mechanism, located within the inner funnel member stem portion 246, comprises an inner ring 288 having an opening 290. The inner ring 288 may include a sloped or angled surface 292, forming gaps 294A and 294B. The gaps 294A and 294B define an inner funnel member stem portion inner channel 296. The inner funnel member stem portion 246 comprises an inner ring 288 that is sized and shaped to receive and hold therein the fluid flow stop 278, particularly the fluid flow stop main body 282. In the second, non-fluid flow position, see FIG. 30B, the first portion of the fluid flow mechanism interacts with the second portion of the fluid flow mechanism to prevent fluid from flowing through the inner funnel member top portion 244, into the inner funnel member stem portion 246, and out from the outer portion opening 234.

As the inner funnel member 214 is pushed down and inward against the outer funnel member 212, portions of the inner funnel member stem portion 246, referred to herein as the inner funnel member locking stem portion 298 fit within, slide down and are guided within the fluid flow prevention mechanism inner interior or channel 274. The inner funnel member locking stem portion 298 may include a tapered end portion 300 which glides past the fluid flow stop outer rim 280 and extends into the guide channel 284. The inner funnel member locking stem portion 298 may stop and rest along shoulder stop 286. The fluid flow stop main body 282 is inserted into the second portion of the fluid flow mechanism inner ring opening 290, resting within the second portion of the fluid flow mechanism inner ring 288. The inner funnel member stem portion inner ring 288, or any other portion of the inner funnel member 214, may be made of a flexible material or a materiel that stretches or expands when a force is applied, and reverts back to its original shape when the force is removed. In this position, the bottom portion or surface 302 of the second portion of the fluid flow mechanism inner ring 288 rests along the upper surface 304 of the fluid flow stop outer rim 280. In this position, the spring 262 may be in a compressed state. Upon traversal from the second, non-fluid flow position to the first, fluid flow position, the spring 262 may return to its resting, non-compressed state, pushing the inner funnel member 214 upwardly.

Figure 31:
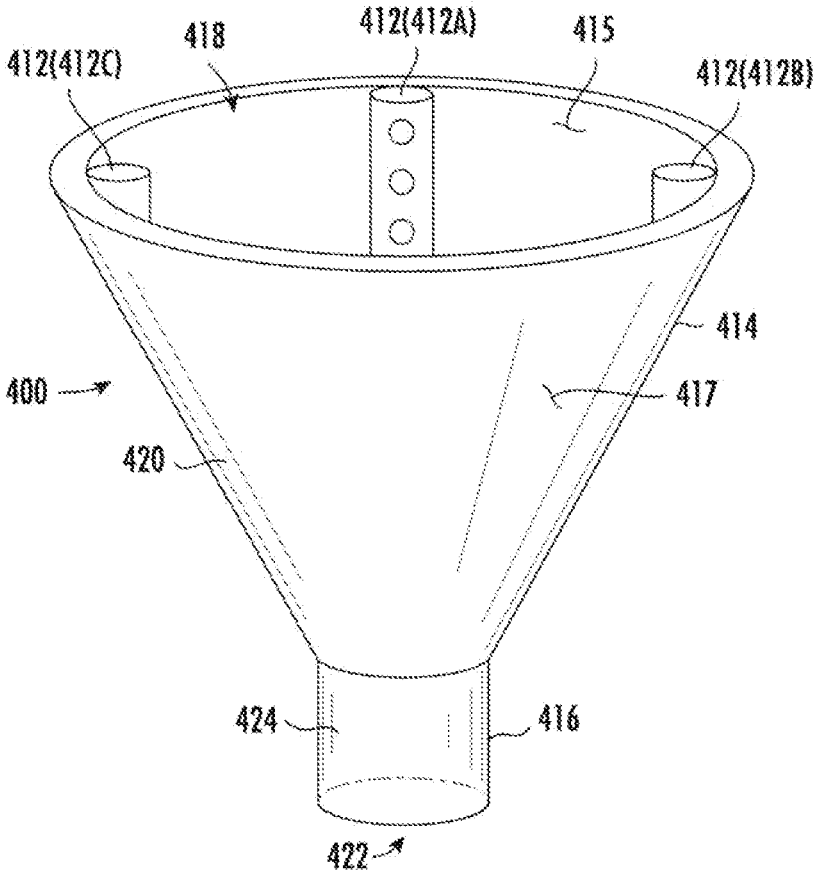
FIG. 31 is a perspective view of an illustrative example of a vented funnel.

Referring to FIG. 31, an illustrative example of a funnel, referred to herein as a vented funnel 400, is shown. The vented funnel 400 is configured to provide for more even fluid flow and to maximize fluid flow. The vented funnel 400 may have one or more venting tubes 412 configured to provide a mechanism for allowing trapped air within the vented funnel 400 to be expelled. The vented funnel 400 may include a top portion 414 and a stem portion 416, with the top portion 414 being larger than the stem portion 416; the vented funnel 400 having an interior surface 415 and an exterior surface 417. The top portion 414 includes a vented funnel first opening 418 and a top body portion 420. The body portion 420 preferably has a taper. The stem portion 416 includes a vented funnel second opening 422 and a stem body 424. The stem body 424 is illustrated as having a cylindrical shape sized to fit and rest within a bottle or container into which a liquid may be transferred. While the stem body 424 is illustrated as having a cylindrical shape, such shape is illustrative only and may form any shape. Preferably, the vented funnel first opening 418 is wider than the vented funnel second opening 422.

Figure 32:
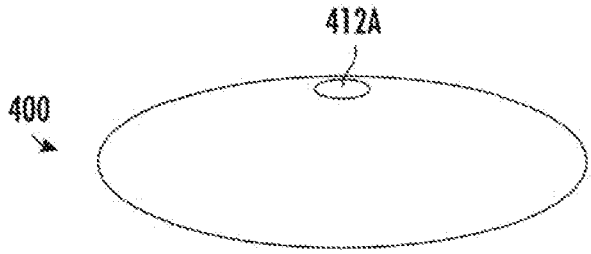
FIG. 32 illustrates an embodiment of the vented funnel having a single venting tube.
Figure 33:
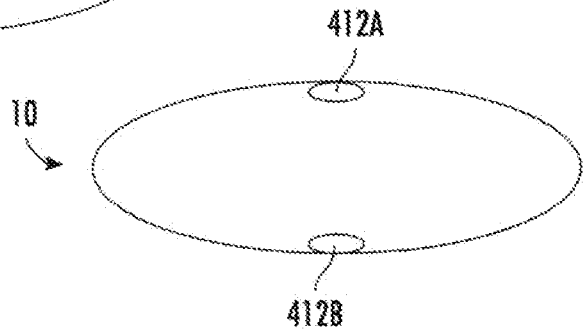
FIG. 33 illustrates an embodiment of the vented funnel having two venting tubes.
Figure 34:
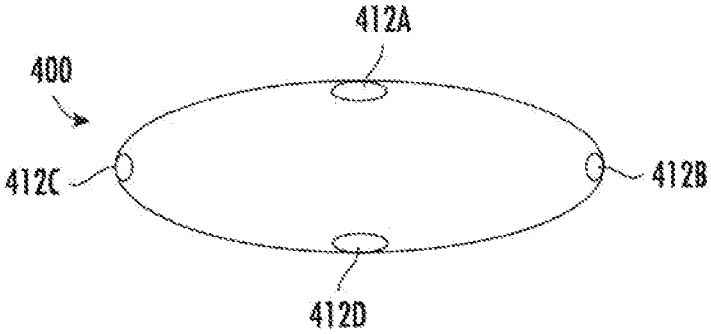
FIG. 34 illustrates an embodiment of the vented funnel having four venting tubes.
Figure 35:
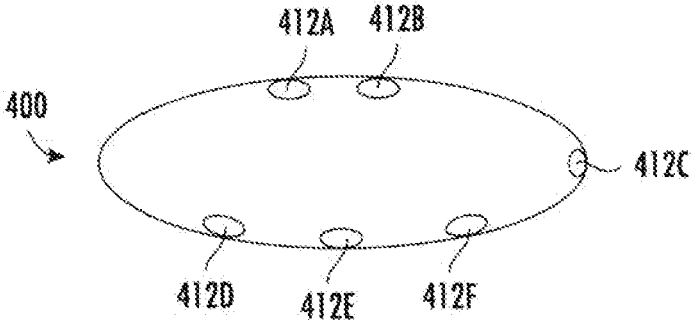
FIG. 35 illustrates an embodiment of the vented funnel having six venting tubes.

Placed or formed within the interior surface 415 are the one or more venting tubes 412. FIG. 31 illustrates the vented funnel 400 having three venting tubes 412, referred to individually as a first venting tube 412A, a second venting tube 412B, and a third venting tube 412C. While the vented funnel 400 is shown having three venting tubes, 412A, 412B, and 412C, such embodiment is illustrative only, as the vented funnel 400 may include less than three venting tubes 412 or more than three venting tubes 412. FIG. 32 illustrates an embodiment of the vented funnel 400 having a single venting tube 412A. FIG. 33 illustrates an embodiment of the vented funnel 400 having two venting tubes, 412A and 412B. FIG. 34 illustrates an embodiment of the vented funnel 400 having four venting tubes, 412A, 412B, 412C, and 412D. FIG. 35 illustrates an embodiment of the vented funnel 400 having six venting tubes, 412A, 412B, 412C, 412D, 412E and 412F.

Figure 36:
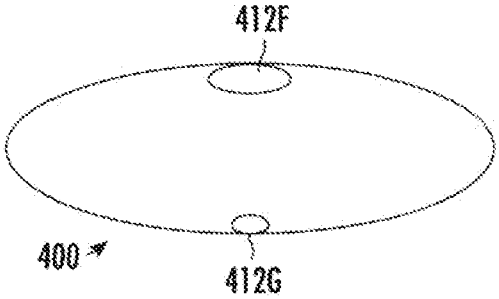
FIG. 36 illustrates an embodiment of the vented funnel having venting tubes of different diameters.

The venting tubes 412 may be evenly spaced about the inner perimeter of the vented funnel 400; see FIGS. 31, 33, and 34. Alternatively, the vented funnel 400 may include multiple venting tubes 412 not arranged evenly spaced apart. The venting tubes 412 may each be the same size or have the same diameter, see FIG. 31-35. Alternatively, the vented tubes 412 may be different sizes or diameters. FIG. 36 illustrates an embodiment of the vented funnel 400 having venting tubes of different diameters, venting tube 412F having a larger diameter than venting tube 412G.

Figure 37:
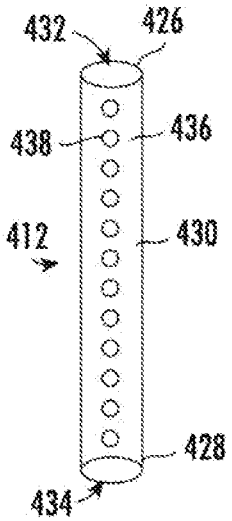
FIG. 37 illustrates an embodiment of the venting tubes in which the circular opening vents are of the same size or same diameter and uniformly dispersed along the length of the venting tube main body.
Figure 38:
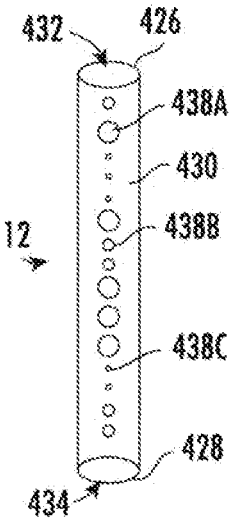
FIG. 38 illustrates an embodiment of the venting tubes in which the circular opening vents are of different sizes or diameters.
Figure 39:
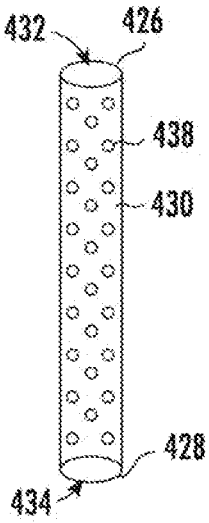
FIG. 39 illustrates an embodiment of the venting tubes in which the circular opening vents are non-uniformly dispersed along the length of the venting tube main body.

FIG. 37 is an illustrative embodiment of the venting tube 412. The venting tube 412 may comprise a first end 426, a second opposing end 428, and a main body 430 separating the first end 426 and the second opposing end 428. The first end 426 may include a first opening 432. The second end 428 may include a second opening 434. Positioned or formed within the outer surface or wall 436 of the venting tube 412 is one or more vents 438, illustrated herein as circular openings. The circular opening vents 38 may be the same size or have the same diameter and be uniformly dispersed along the length of the venting tube main body 430, see FIG. 37. The circular opening vents 438 may be different sizes or diameters, see FIG. 38 (large circular opening vents 438A, medium circular opening vents 438B, small circular opening vents 438C). The circular opening vents 438 may be non-uniformly dispersed along the length of the venting tube main body 430, see FIG. 39.

Figure 40:
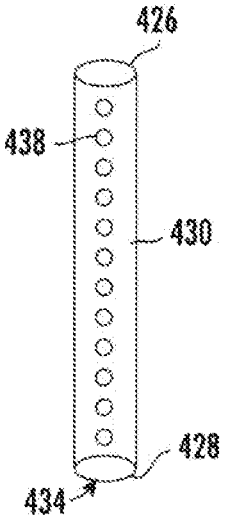
FIG. 40 illustrates an embodiment of the venting tube with a closed first end.

FIG. 40 illustrates an embodiment of the venting tube 412 in which the first end 426 is closed.

Figure 41:
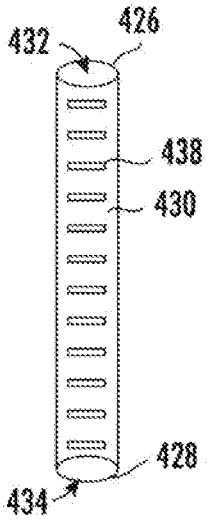
FIG. 41 illustrates an embodiment of the venting tube in which the one or more vents are illustrated as slotted openings.

FIG. 41 illustrates an embodiment of the venting tube 412 in which the one or more vents 438 are illustrated as slotted openings.

Figure 42:
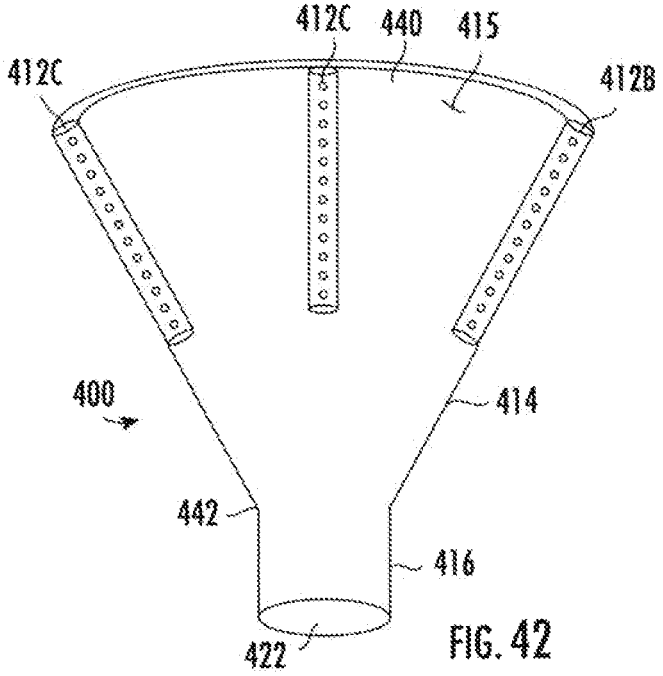
FIG. 42 illustrates the vented funnel with the front portion of the exterior surface removed to show the plurality of venting tubes extending from the top surface of the first portion, down towards the area where the top portion meets the stem.
Figure 44:
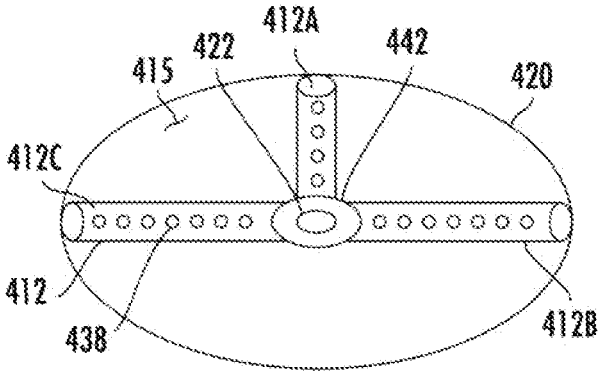
FIG. 44 is a top, partially rotated view showing the vented funnel with the plurality of venting tubes extending from the top surface of the first portion, down towards the area where the top portion meets the stem.

Referring to FIG. 42, the vented funnel 400 is shown with the front portion of the exterior surface 417 removed. The plurality of venting tubes 412A, 412B, and 412C are shown to extend from the top surface 440 of the first portion 414 down towards the area or demarcation line 442 where the first portion 414 meets the stem portion 416. The vented funnel 400 may be designed so the venting tubes 412 are sized to run such length or any length in between. FIG. 44 is a top, partially rotated view looking down and also illustrates the plurality of venting tubes 412A, 412B, and 412C extending from the top surface 440 of the first portion 414 down towards the areas or demarcation line 442.

Figure 43:
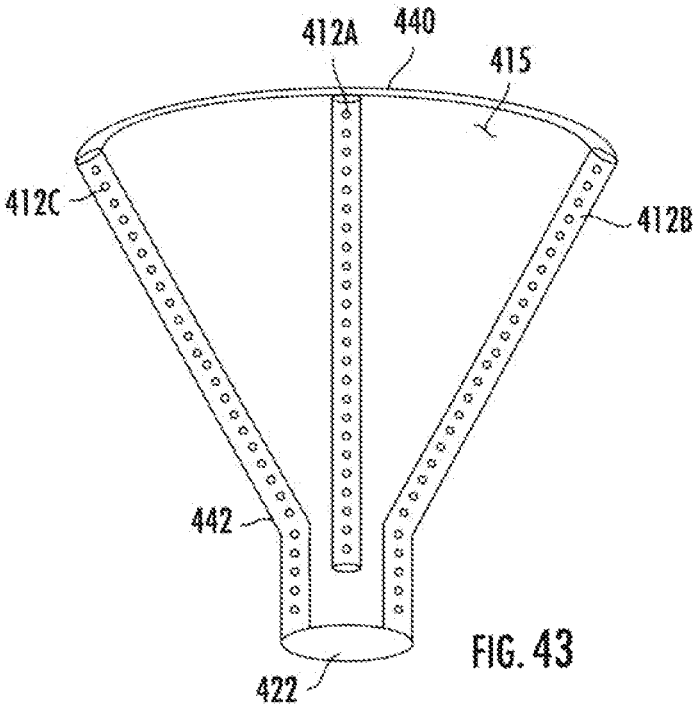
FIG. 43 illustrates the vented funnel with the front portion of the exterior surface removed to show the plurality of venting tubes extending from the top surface of the first portion, down towards the vented funnel second opening.
Figure 45:
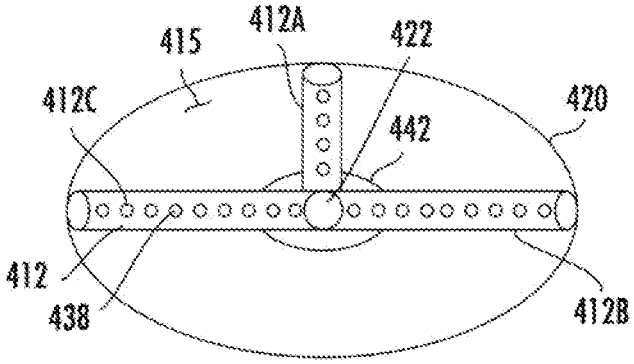
FIG. 45 is a top, partially rotated view showing the vented funnel with the plurality of venting tubes extending from the top surface of the first portion, down towards the vented funnel second opening.

Referring to FIG. 43, the vented funnel 400 is shown with the front portion of the exterior surface 417 removed. The plurality of venting tubes 412A, 412B, and 412C are shown to extend from the top surface 440 of the first portion 414 down towards the vented funnel second opening 422. The vented funnel 400 may be designed so the venting tubes 412 are sized to run such length or any length in between. FIG. 45 is a top, partially rotated view looking down and also illustrates the plurality of venting tubes 412A, 412B, and 412C extending from the top surface 440 of the first portion 414 down towards vented funnel second opening 422.

Figure 46:
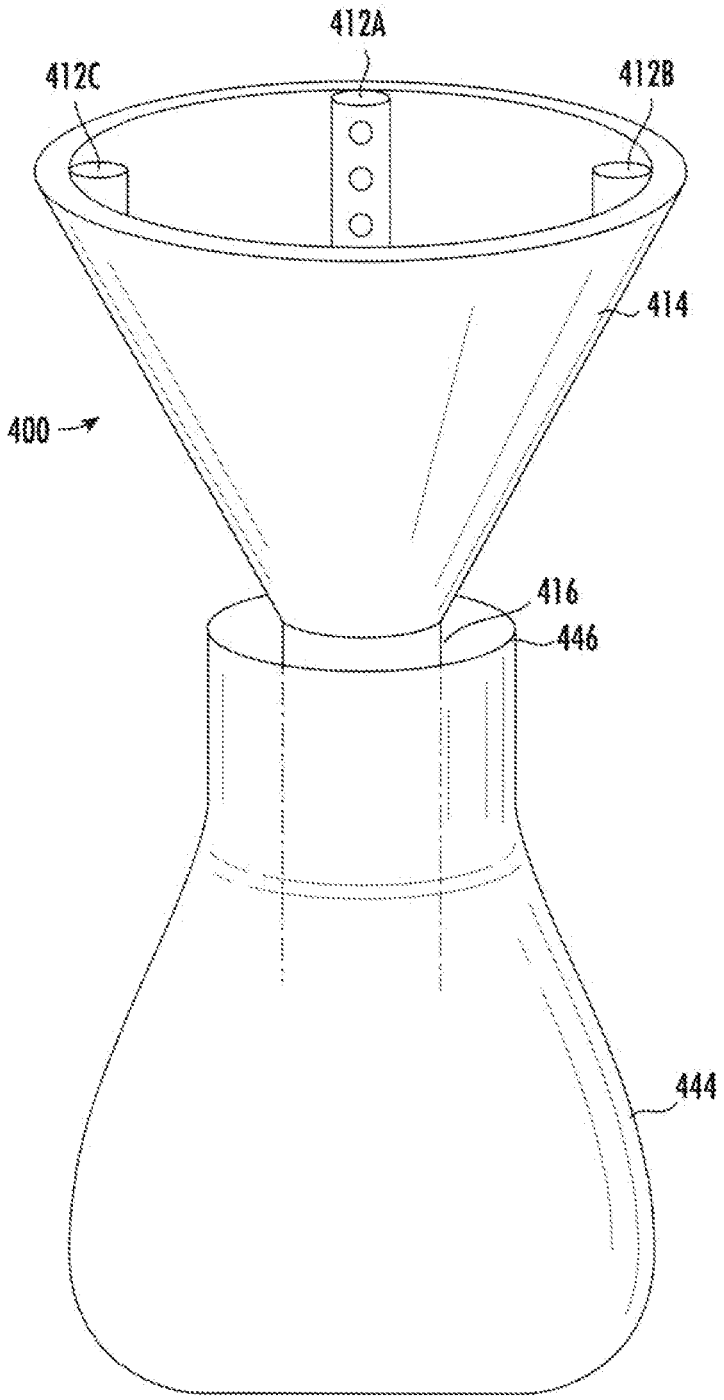
FIG. 46 illustrates the vented funnel placed within a container.

In use, the vented funnel 400 may be placed within a container 444, see FIG. 46. As shown, the stem 416 rests within the mouth 446 of the container 444. As liquid is continually poured into the top portion 414 of the vented funnel 400, constant fluid flow into the container 444 is maintained as any trapped air releases or escapes out through the venting tubes 412 through the one or more vents 438.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A vented funnel with fluid flow stop, comprising:

an inner member comprising a top portion constructed and arranged to receive or hold a fluid, and a stem portion comprising an opening and constructed and arranged to direct said fluid from said inner member top portion therethrough; and an outer member comprising a top portion constructed and arranged to receive or hold a portion of said inner member top portion, and a stem portion constructed and arranged to receive at least a portion of said inner member stem portion, said outer member stem portion comprising at least one aperture and a fluid sealing member;

wherein, said inner member is positioned within said outer member and orientated to move therein when a force is applied or removed, thereby traversing between a first position and a second position, wherein at least one position allows fluid to flow out of said vented funnel and said other position prohibits said fluid from flowing out of said vented funnel and allows said fluid to pool within said inner member.

2. The vented funnel with fluid flow stop according to claim 1, wherein said inner member further comprises a spring.

3. The vented funnel with fluid flow stop according to claim 1, wherein said fluid sealing member is centrally positioned within said outer member stem portion and is surrounded by a plurality of said apertures.

4. The vented funnel with fluid flow stop according to claim 1, wherein said fluid sealing member is constructed and arranged to fit within said inner member stem portion opening.

5. The vented funnel with fluid flow stop according to claim 1, wherein said fluid sealing member includes ramped surfaces constructed and arranged to guide interaction of said inner member with said outer member.

6. The vented funnel with fluid flow stop according to claim 1, wherein said outer member comprises one or more inner member engagement members constructed and arranged to engage with at least a portion of said inner member.

7. The vented funnel with fluid flow stop according to claim 1, wherein said inner member comprises one or more outer member engagement members constructed and arranged to engage with at least a portion of said outer member.

8. The vented funnel with fluid flow stop according to claim 1, wherein said inner member has a shape of a funnel.

9. The vented funnel with fluid flow stop according to claim 1, wherein said outer member has a shape of a funnel.

10. The vented funnel with fluid flow stop according to claim 1, wherein said inner member includes a lip.

11. The vented funnel with fluid flow stop according to claim 1, wherein said outer member includes a lip.

12. The vented funnel with fluid flow stop according to claim 1, wherein said inner member includes a fluid level indicator.

13. The vented funnel with fluid flow stop according to claim 1, wherein said inner member has an outer diameter that is less than an inner diameter of said outer member.

14. The vented funnel with fluid flow stop according to claim 1, wherein said first position is an open fluid flow position which allows fluid to flow out of said vented funnel, and said second position is a closed fluid flow position which prevents said fluid from flowing out of said vented funnel, allowing said fluid to pool within said inner member.

15. The vented funnel with fluid flow stop according to claim 1, wherein said first position is a closed fluid flow position which prevents said fluid from flowing out of said vented funnel, allowing said fluid to pool within said inner member, and said second position is an open fluid flow position which allows said fluid to flow out of said vented funnel.

16. The vented funnel with fluid flow stop according to claim 1, further including a locking member.

17. The vented funnel with fluid flow stop according to claim 1, wherein said outer member stem portion further includes one or more venting members configured to allow for movement of air in or out of said vented funnel.

18. The vented funnel with fluid flow stop according to claim 17, wherein said outer member stem portion further includes multiple venting members arranged about a perimeter of said outer member stem portion.

19. The vented funnel with fluid flow stop according to claim 17, wherein said one or more venting members further include an opening.

20. A funnel comprising:

an inner funnel comprising a top portion constructed and arranged to receive a fluid, and a stem portion comprising a body terminating in an opening, said body constructed and arranged to direct said fluid from said inner funnel top portion, out through said opening, an outer funnel comprising a top portion constructed and arranged to receive and house said inner funnel top portion, and a stem portion constructed and arranged to receive at least a portion of said inner funnel stem portion and terminating in at least one aperture;

said inner funnel positioned within said outer funnel and orientated to move within said outer funnel, traversing between two positions; and a fluid flow restrictor positioned within said outer funnel stem portion;

wherein, when said inner funnel is in a fluid flow position, said inner funnel is not engaged with said fluid flow restriction restrictor, thereby allowing said fluid to flow out of said funnel, and wherein, when said inner funnel is in a non-fluid flow position, said inner funnel engages with said fluid flow restrictor, preventing said fluid from flowing out of said funnel and allowing said fluid to accumulate within said inner funnel.

* * * * *